US011061343B2

(12) United States Patent
Mizoguchi et al.

(10) Patent No.: US 11,061,343 B2
(45) Date of Patent: Jul. 13, 2021

(54) TONER, TONER STORED UNIT, AND IMAGE FORMING APPARATUS

(71) Applicants: Yuka Mizoguchi, Shizuoka (JP); Ryota Inoue, Shizuoka (JP); Hiroshi Yamashita, Shizuoka (JP); Minoru Masuda, Shizuoka (JP); Daichi Hisakuni, Shizuoka (JP); Tomomi Harashima, Kanagawa (JP)

(72) Inventors: Yuka Mizoguchi, Shizuoka (JP); Ryota Inoue, Shizuoka (JP); Hiroshi Yamashita, Shizuoka (JP); Minoru Masuda, Shizuoka (JP); Daichi Hisakuni, Shizuoka (JP); Tomomi Harashima, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/793,039

(22) Filed: Feb. 18, 2020

(65) Prior Publication Data

US 2020/0285167 A1 Sep. 10, 2020

(30) Foreign Application Priority Data

Mar. 8, 2019 (JP) ..... JP2019-042630

(51) Int. Cl.

| | |
|---|---|
| ***G03G 9/08*** | (2006.01) |
| ***G03G 9/09*** | (2006.01) |
| ***G03G 9/087*** | (2006.01) |
| ***G03G 15/08*** | (2006.01) |

(52) U.S. Cl.

CPC ..... *G03G 9/0902* (2013.01); *G03G 9/0827* (2013.01); *G03G 9/08755* (2013.01); *G03G 9/08795* (2013.01); *G03G 9/08797* (2013.01); *G03G 9/0926* (2013.01); *G03G 15/08* (2013.01)

(58) Field of Classification Search

CPC ..... G03G 9/08755; G03G 9/0827; G03G 9/08795; G03G 9/08797; G03G 9/0902; G03G 9/0926

USPC ..... 430/109.4, 111.4

See application file for complete search history.

(56) References Cited

U.S. PATENT DOCUMENTS

| | | | |
|---|---|---|---|
| 2016/0195827 | A1 | 7/2016 | Murayama et al. |
| 2016/0195828 | A1 | 7/2016 | Satoh et al. |
| 2016/0266507 | A1 | 9/2016 | Watanabe et al. |
| 2016/0334722 | A1 | 11/2016 | Makabe et al. |
| 2016/0370720 | A1 | 12/2016 | Yamashita et al. |
| 2017/0050204 | A1 | 2/2017 | Shitara et al. |
| 2017/0108791 | A1 | 4/2017 | Hashida et al. |

(Continued)

FOREIGN PATENT DOCUMENTS

| | | |
|---|---|---|
| JP | 2012-042624 | 3/2012 |
| JP | 2017-062410 | 3/2017 |
| JP | 2017-097019 | 6/2017 |

*Primary Examiner* — Mark A Chapman

(74) *Attorney, Agent, or Firm* — Oblon, McClelland, Maier & Neustadt, L.L.P.

(57) ABSTRACT

A toner including: a plate-shaped pigment containing a metal as a main component; and a binder resin containing polyester resin (A) that is insoluble in THF, wherein: a weight average molecular weight (Mw) of a tetrahydrofuran (THF)-soluble component of the toner as determined by gel permeation chromatography (GPC) is 5,000 or higher but 14,000 or lower; and a glass transition temperature (Tg) of a THF-insoluble component of the toner as determined from a differential scanning colorimetry (DSC) curve at first heating in DSC is −60° C. or higher but 10° C. or lower.

7 Claims, 2 Drawing Sheets

(56) References Cited

U.S. PATENT DOCUMENTS

| | | | |
|---|---|---|---|
| 2017/0139337 | A1 | 5/2017 | Kaneko et al. |
| 2018/0052403 | A1 | 2/2018 | Inoue et al. |
| 2018/0224763 | A1 | 8/2018 | Tanaka et al. |
| 2018/0267417 | A1 | 9/2018 | Mizoguchi et al. |
| 2018/0267420 | A1 | 9/2018 | Yamashita et al. |
| 2018/0364600 | A1 | 12/2018 | Fuwa et al. |
| 2019/0235405 | A1 | 8/2019 | Masuda et al. |

TONER, TONER STORED UNIT, AND IMAGE FORMING APPARATUS

CROSS-REFERENCE TO RELATED APPLICATIONS

This patent application is based on and claims priority pursuant to 35 U.S.C. § 119(a) to Japanese Patent Application No. 2019-042630, filed on Mar. 8, 2019 in the Japan Patent Office, the entire disclosure of which is hereby incorporated by reference herein.

BACKGROUND

Technical Field

The present disclosure relates to a toner, a toner stored unit, and an image forming apparatus.

Description of the Related Art

As electrophotographic color image forming apparatuses are widely used, they have found a wide variety of applications, and a demand has arisen for metallic-texture images as well as existing color images.

To form an image with glittering texture like a metal, a glittering toner containing a metal pigment in a binder resin is used.

An image with metallic luster is desired to have high reflectivity to light from a certain angle. To this end, a toner for electrostatic image development (hereinafter referred to simply as a "toner") is allowed to contain a highly reflective pigment with a scaly plane (i.e., a glittering pigment).

Such a highly reflective pigment is appropriately a metal or a metal-coated pigment. To make sure to obtain reflectivity, pigment particles each having a plane with a certain area are arranged in-plane in a toner-fixed image.

SUMMARY

According to one aspect of the present disclosure, a toner includes a plate-shaped pigment containing a metal as a main component, and a binder resin containing polyester resin (A) that is insoluble in THF. A weight average molecular weight (Mw) of a tetrahydrofuran (THF)-soluble component of the toner as determined by gel permeation chromatography (GPC) is 5,000 or higher but 14,000 or lower. A glass transition temperature (Tg) of a THF-insoluble component of the toner as determined from a differential scanning colorimetry (DSC) curve at the first heating in DSC is −60° C. or higher but 10° C. or lower.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1:
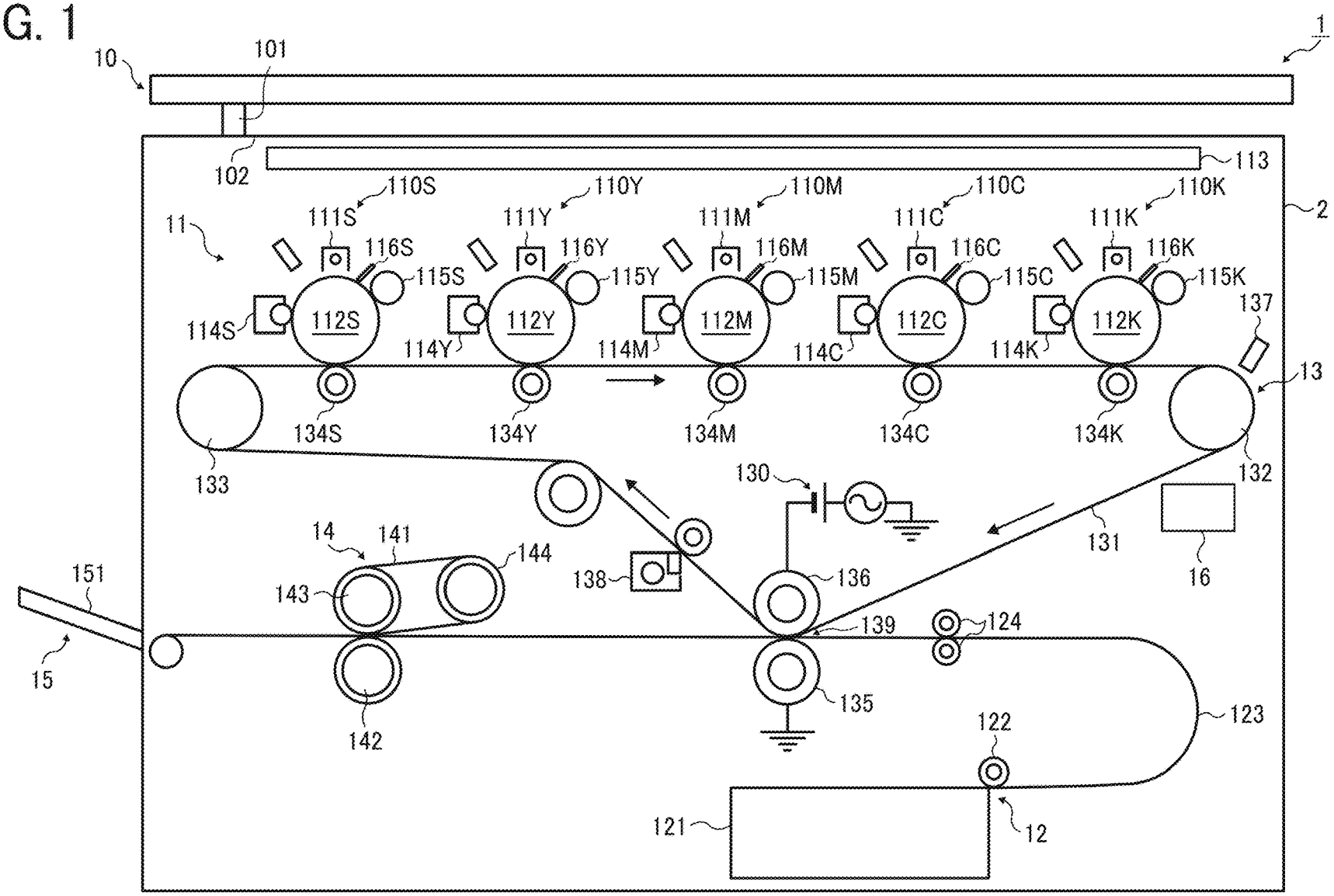
FIG. 1 is an entire configurational view of an image forming apparatus embodying the present disclosure.

The accompanying drawings are intended to depict embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

In attempting to ensure excellent glittering texture, a toner having an average molecular weight of 15,000 or higher but 300,000 or lower has been proposed wherein a ratio of (AB) is 2 or more but 100 or less where A denotes a reflectance at a light-receiving angle of +30° and B denotes a reflectance at a light-receiving angle of −30° as measured when applying incident light to an image at an incident angle of −45°.

Moreover, a toner having a lowered molecular weight has been proposed in attempting to provide an image with high glittering texture and suppress toner scattering in a high-temperature, high-humidity environment.

Hitherto, it has been considered that a glittering image is achieved when the planes of glittering pigment particles are aligned in the surface of an image formed of a toner to efficiently reflect light.

However, when the planes of the glittering pigment particles each having a plate shape are aligned at small intervals on an image formed of a high-molecular-weight toner, the adhesive force between the plate-shaped glittering pigment and the resin becomes low, leading to exfoliation of the image at the interfaces of the glittering pigment particles upon rubbing of the image.

Use of low-molecular-weight toners results in increase in adhesiveness between the glittering pigment and the resin but in decrease in margin of the fixing temperature.

The conventional toners as described above are not satisfactory from the viewpoint of providing a toner that ensures glittering texture of an image and a wide fixing temperature range, and is capable of suppressing exfoliation of an image.

Under such circumstances, the inventors of the present invention conducted extensive studies and have obtained a toner with prevented hot offset and high fixing margin by lowering the molecular weight of the toner and using a resin having a very low Tg and a cross-linked structure. The highly flowable resin having a low Tg can increase adhesiveness between the glittering pigment and the binder resin, which makes it possible to suppress exfoliation of the image due to the proximity or adhesion between the pigment particles.

According to an embodiment of the present disclosure, it is possible to provide a toner that ensures glittering texture of an image and a wide fixing temperature range, and is capable of suppressing exfoliation of an image.

A method for producing the toner of the present disclosure will be described below in more detail.

(Toner)

A toner of the present disclosure includes a plate-shaped pigment containing a metal as a main component, and polyester resin (A) insoluble in THF, and if necessary, further includes other components such as a colorant and a release agent. In the present disclosure, the plate-shaped pigment containing a metal as a main component refers to a plate-shaped pigment containing a metal in an amount of higher than 50% by mass.

As a result of the extensive studies conducted by the inventors of the present invention, they have found that a toner containing a plate-shaped pigment tends to easily cause exfoliation of a resultant image at the interfaces between pigment particles because the pigment particles are scaly (plate-shaped) or flat and the plate-shaped pigment particles easily come close to or come into contact with each other in a fixed image.

The inventors of the present invention have then found that by allowing a toner to have a relatively low molecular weight, specifically, by using a resin having a weight average molecular weight (Mw) of from 5,000 through 14,000 in terms of polystyrene in GPC, the pigment and the resin can firmly adhere to each other to prevent contact between pigment particles.

When the weight average molecular weight of the toner is lower than 5,000, hot offset occurs upon fixing at high temperatures. When the weight average molecular weight of the toner is higher than 14,000, adhesiveness between the pigment and the resin becomes low.

When the glass transition temperature (Tg) of the polyester resin (A), which is a polymer or three-dimensionally cross-linked product insoluble in THF (a so-called gel portion), is adjusted to be −60° C. or higher but 10° C. or lower, the toner exhibits properties like rubber so that the toner easily deforms in a low-temperature region, but an excessive degree of flow of the toner can be suppressed. This makes it possible to suppress occurrence of hot offset and widen the margin of fixing (i.e., a temperature range where fixing is possible). When the glass transition temperature (Tg) of the polyester resin (A) is in the predetermined range, the toner is highly flowable at low temperatures, and can enter the gap between the pigment particles to prevent the proximity and contact between the pigment particles. When the Tg of the polyester resin (A) is lower than −60° C., the glass transition temperature as the resultant toner is too low, which is not preferable from the viewpoint of heat resistant storage stability. When the Tg of the polyester resin (A) is higher than 10° C., the flowability of the resultant toner at low temperatures is insufficient, which makes it difficult for the toner to enter the gap between the pigment particles. A more preferable temperature range of the Tg of the polyester resin (A) is −40° C. or higher but 0° C. or lower.

The proportion of THF-insoluble components in the toner may be 5% or more but 15% or less. When the proportion is 5% or more, adhesiveness between the pigment and the resin is sufficient, which makes it possible to prevent contact between pigment particles. When the proportion is 15% or less, the minimum fixing temperature can be lowered, and the margin of fixing is not narrowed.

<Weight Average Molecular Weight (Mw) of THF-Soluble Component>

In the present disclosure, the molecular weight distribution and the weight average molecular weight (Mw) of the tetrahydrofuran-soluble component of the toner and the resin can be measured using a gel permeation chromatography (GPC) measuring device (e.g., HLC-8220GPC (available from Tosoh Corporation)). A column used is TSKgel SuperHZM-H 15 cm triple (available from Tosoh Corporation). A sample used for the measurement is prepared as follows. Specifically, the toner subjected to measurement is dissolved in tetrahydrofuran (THF) (containing a stabilizing agent, available from Wako Pure Chemical Corporation) to prepare a 0.15% by mass solution. The solution is filtrated through 0.2 μm filter. The resultant filtrate is used as the sample. The THF sample solution (100 μL) is applied to the measurement device, followed by measurement in an environment of 40° C. and at a flow rate of 0.35 mL/min.

The molecular weight is calculated based on a calibration curve created using monodisperse polystyrene standard samples. The polystyrene standard samples used are Showdex STANDARD series (available from SHOWA DEKKO K.K.) and toluene. Specifically, THF solutions of the following three kinds of monodisperse polystyrene standard samples are prepared and measured under the above conditions to create the calibration curve with the retention time of the peak top as the light scattering molecular weight of the monodisperse polystyrene standard samples.

Solution A: S-7450 2.5 mg, S-678 2.5 mg, S-46.5 2.5 mg, S-2.90 2.5 mg, THE 50 mL Solution B: S-3730 2.5 mg, S-257 2.5 mg, S-19.8 2.5 mg, S-0.580 2.5 mg, THF 50 mL Solution C: S-1470 2.5 mg, S-112 2.5 mg, S-6.93 2.5 mg, toluene 2.5 mg, THE 50 mL A detector used is a refractive index (RI) detector.

<Polyester Resin (A) Insoluble in THF>

A method for obtaining the THF-insoluble component of the toner is, for example, a dissolution filtration method or a method of obtaining an extraction residue using a common Soxhlet extraction. Any method may be used without any problem. In the present disclosure, the dissolution filtration method as described below is used to obtain the THF-insoluble component. The THF-insoluble component refers to an amount excluding the pigment.

The method for obtaining the THE-insoluble component of the toner by the dissolution filtration method will be described below.

First, 1 g of the toner is weighed and charged into 100 mL of THF, followed by stirring for 6 hours using a stirrer in an environment of 25° C., to obtain a solution containing soluble components of the toner dissolved in the solution. The solution is filtrated with a membrane filter having an opening of 0.2 μm. The filtrated product is charged again into 50 mL of THF, followed by stirring for 10 minutes using a stirrer. This procedure is repeated twice or three times, and the filtrated product is dried in an environment of 120° C. and 10 kPa or lower, to obtain the THF-insoluble component.

In the case of using Soxhlet extraction, it is desirable that 1 part of the toner and 100 parts of THF be refluxed for 6 hours or longer to fractionate the THF-insoluble component and the THF-soluble component.

The glass transition temperature of, for example, the toner, the THF-insoluble component, and the rein in the present disclosure can be measured using a differential scanning calorimeter (DSC) (e.g., Q-200 (available from TA Instruments Inc.)). Specifically, 5.0 mg of a target sample is placed in an aluminium sample container, the sample container is placed on a holder unit, and the holder unit is set in an electric furnace. Measurement is performed by heating the sample from −80° C. to 150° C. at a heating speed of 10° C./min in a nitrogen atmosphere (this process is defined as the first heating). Next, the sample is cooled from 150° C. to −80° C. at a cooling speed of 10° C./min (cooling process) and is again heated to 150° C. at a heating speed of 10°

C./min (this process is defined as the second heating). Endothermic and exothermic changes in these processes are measured to draw graphs of temperature versus endothermic and exothermic quantities, and DSC curves can be obtained.

The obtained DSC curves are analyzed using the analysis program installed in the Q-200 system to select a DSC curve at the first heating. The glass transition temperature of the target sample is determined from an intersection point of an extended line of a base line of the DSC curve of the temperature lower than enthalpy relaxation of an endothermic quantity, and a tangent of the maximum angle of inclination at enthalpy relaxation. When the sample has a melting point, a peak top temperature of the endothermic quantity of the DSC curve at the first heating is determined as the melting point.

—Polyester Resin (A)—

The polyester resin (A) may be any resin insoluble in THF as long as it satisfies the conditions of the present disclosure. The polyester resin (A) is desirably a resin that exhibits behaviors like rubber in an environment of a temperature at which the toner is used. The polyester resin (A) preferably has a cross-linked structure and a glass transition temperature at a low-temperature region of 20° C. or lower, and exhibits such viscoelastic behaviors that have a rubber-like flat region in an environment of room temperature or higher.

When a urethane bond or a urea bond is introduced into the structure of the polyester resin (A), the resin obtained has excellent rubber elasticity by virtue of its intermolecular cohesive force. This is preferable because the resultant toner is excellent in heat resistant storage stability and mechanical durability. Adjusting the concentration of the urethane bond or the urea bond in the structure of the resin can control the storage elastic modulus of the THF-insoluble component of the toner.

The polyester resin (A) having the cross-linked structure may be obtained by any method. In one example, a reactive precursor (hereinafter referred to also as "prepolymer") can be reacted with a curing agent to obtain the polyester resin (A) having the cross-linked structure. A method for introducing the polyester resin (A) into the toner may be introduction of the polyester resin (A) having the cross-linked structure obtained through the reaction. Alternatively, while the reactive precursor and the curing agent are being reacted in the toner particles in the toner production process, the polyester resin (A) having the cross-linked structure may be introduced into the toner. The latter method is preferable in terms of uniformity of toner quality because the polyester resin (A) can be uniformly introduced into the toner.

The reactive precursor is not particularly limited and may be appropriately selected depending on the intended purpose as long as the reactive precursor is a polyester resin having a group reactive with the curing agent.

Examples of the group reactive with the curing agent in the reactive precursor include, but are not limited to, a group reactive with an active hydrogen group. Examples of the group reactive with the active hydrogen group include, but are not limited to, an isocyanate group, an epoxy group, a carboxylic acid, and an acid chloride group. Among them, an isocyanate group is preferable in view that a urethane bond or a urea bond can be introduced into the amorphous polyester resin.

The reactive precursor may have a branched structure given by a trivalent or higher valent alcohol or a trivalent or higher valent carboxylic acid, or both.

Examples of the polyester resin having the isocyanate group include, but are not limited to, a reaction product between a polyester resin having an active hydrogen group and a polyisocyanate. The polyester resin having the active hydrogen group is obtained by, for example, polycondensation among a diol, a dicarboxylic acid, and a trivalent or higher valent alcohol or a trivalent or higher valent carboxylic acid, or both. The trivalent or higher valent alcohol and the trivalent or higher valent carboxylic acid give a branched structure to the polyester resin having the isocyanate group.

Examples of the diol include, but are not limited to: aliphatic diols, such as ethylene glycol, 1,2-propylene glycol, 1,3-propylene glycol, 1,4-butanediol, 2-methyl-1,3-propanediol, 1,5-pentanediol, 3-methyl-1,5-pentanediol, 1,6-hexanediol, 1,8-octanediol, 1,10-decanediol, and 1,12-dodecanediol; diols having an oxyalkylene group, such as diethylene glycol, triethylene glycol, dipropylene glycol, polyethylene glycol, polypropylene glycol, and polytetramethylene glycol; alicyclic diols, such as 1,4-cyclohexane dimethanol and hydrogenated bisphenol A; alkylene oxides (e.g., ethylene oxide, propylene oxide, and butylene oxide) adducts of alicyclic diols; bisphenols, such as bisphenol A, bisphenol F, and bisphenol S; and alkylene oxide adducts of bisphenols, such as alkylene oxide (e.g., ethylene oxide, propylene oxide, and butylene oxide) adducts of bisphenols.

Among them, from the viewpoint of controlling the glass transition temperature of the polyester resin (A) to 20° C. or lower, it is preferable to use aliphatic diols having 3 or more but 10 or less carbon atoms, such as 1,2-propylene glycol, 1,3-propylene glycol, 1,4-butanediol, 2-methyl-1,3-propanediol, 1,5-pentanediol, and 3-methyl-1,5-pentanediol. It is more preferable that the aliphatic diol having 3 or more but 10 or less carbon atoms account for 50 mol % or more of the alcohol component in the resin. The above diols may be used alone or in combination.

The polyester resin (A) is desirably an amorphous resin. When steric hindrance is given to the resin chain, melt viscosity during fixing decreases, and low-temperature fixability develops more easily. Therefore, the main chain of the aliphatic diol preferably has a structure represented by General Formula (1) below.

General Formula (1)

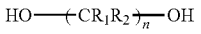

In General Formula (1), $R_1$ and $R_2$ are each independently a hydrogen atom or an alkyl group having from 1 through 3 carbon atoms, and n is an odd number of from 3 through 9, provided that $R_1$ and $R_2$ may be identical to or different from each other in the units repeated in the number of n.

The main chain of the aliphatic diol in the present disclosure is a carbon chain linking two hydroxyl groups included in the aliphatic diol with the minimum number of carbon atoms. When the number of carbon atoms of the main chain is an odd number, it is preferable because crystallinity decreases due to parity. When the side chain includes at least one alkyl group having from 1 through 3 carbon atoms, it is more preferable because interaction energy between molecules of the main chain decreases due to the steric effect.

Examples of the dicarboxylic acid include, but are not limited to: aliphatic dicarboxylic acids, such as succinic acid, adipic acid, sebacic acid, dodecanedioic acid, maleic acid, and fumaric acid; and aromatic dicarboxylic acids, such as phthalic acid, isophthalic acid, terephthalic acid, and naphthalene dicarboxylic acid. Moreover, anhydrides thereof, lower (the number of carbon atoms: from 1 through 3) alkyl esters thereof, and halogenated products thereof may be used. Among them, aliphatic dicarboxylic acids having 4 or more but 12 or less carbon atoms are preferable from the viewpoint of controlling the Tg of the polyester resin (A) to 20° C. or lower. It is more preferable that the aliphatic dicarboxylic acid having 4 or more but 12 or less carbon atoms account for 50% by mass or more of the carboxylic acid component in the resin. The above dicarboxylic acids may be used alone or in combination.

Examples of the trivalent or higher valent alcohol include, but are not limited to: trivalent or higher valent aliphatic alcohols, such as glycerin, trimethylolethane, trimethylolpropane, pentaerythritol, and sorbitol; trivalent or higher valent polyphenols, such as trisphenol PA, phenol novolac, and cresol novolac; and alkylene oxide adducts of trivalent or higher valent polyphenols, such as alkylene oxide (e.g., ethylene oxide, propylene oxide, and butylene oxide) adducts of trivalent or higher valent polyphenols.

Examples of the trivalent or higher valent carboxylic acids include, but are not limited to, trivalent or higher valent aromatic carboxylic acids. Trivalent or higher valent aromatic carboxylic acids having 9 or more but 20 or less carbon atoms, such as trimellitic acid and pyromellitic acid, are particularly preferable. Moreover, anhydrides thereof, lower (the number of carbon atoms: from 1 through 3) alkyl esters thereof, and halogenated products thereof may be used.

Examples of the polyisocyanate include, but are not limited to, diisocyanates and trivalent or higher valent isocyanates.

The polyisocyanate is not particularly limited and may be appropriately selected depending on the intended purpose. Examples of the polyisocyanate include, but are not limited to: aromatic diisocyanates, such as 1,3- and/or 1,4-phenylene diisocyanate, 2,4- and/or 2,6-tolylene diisocyanate (TDI), crude TDI, 2,4'- and/or 4,4'-diphenylmethane diisocyanate (MDI), crude MDI [a phosgenation product of crude diaminophenylmethane [condensation product of formaldehyde and aromatic amine (aniline) or a mixture thereof; a mixture of diaminodiphenylmethane and a small amount (e.g., from 5% by mass through 20% by mass) of trifunctional or higher polyamine]: polyallyl polyisocyanate (PAPI)], 1,5-naphthylene diisocyanate, 4,4',4"-triphenylmethane triisocyanate, and m- and p-isocyanatophenyl sulfonyl isocyanate; aliphatic diisocyanates, such as ethylene diisocyanate, tetramethylene diisocyanate, hexamethylene diisocyanate (HDI), dodecamethylene diisocyanate, 1,6,11-undecane triisocyanate, 2,2,4-trimethylhexamethylene diisocyanate, lysine diisocyanate, 2,6-diisocyanatomethyl caproate, bis(2-isocyanatoethyl)fumarate, bis(2-isocyanatoethyl)carbonate, and 2-isocyanatoethyl-2,6-diisocyanatohexanoate; alicyclic diisocyanates, such as isophorone diisocyanate (IPDI), dicyclohexylmethane-4,4'-diisocyanate (hydrogenated cyclohexylene diisocyanate, methylcyclohexylene diisocyanate (hydrogenated TDI), bis(2-isocyanatoethyl)-4-cyclohexene-1,2-dicarboxylate, and 2,5- or 2,6-norbornane diisocyanate; aromatic aliphatic diisocyanates, such as m- or p-xylylene diisocyanate (XDI), α,α,α',α'-tetramethylxylylene diisocyanate (TMXDI); trivalent or higher valent polyisocyanates, such as lysine triisocyanate, and diisocyanate modified products of trivalent or higher valent alcohol; and modified products of the above-listed isocyanates. These may be used as a mixture of two or more. Examples of the modified products of the above-listed isocyanates include, but are not limited to, modified products containing, for example, a urethane group, a carbodiimide group, an allophanate group, a urea group, a biuret group, an uretdione group, an uretoimine group, an isocyanurate group, and an oxazolidone group.

The curing agent is not particularly limited and may be appropriately selected depending on the intended purpose. Examples of the curing agent include, but are not limited to, an active hydrogen group-containing compound.

Examples of the active hydrogen group in the active hydrogen group-containing compound include, but are not limited to, a hydroxyl group (an alcoholic hydroxyl group or a phenolic hydroxyl group), an amino group, a carboxyl group, and a mercapto group. These may be used alone or in combination.

The active hydrogen group-containing compound is preferably amines because of their ability to form a urea bond.

Examples of the amines include, but are not limited to: aromatic diamines, such as phenylenediamine, diethyltoluenediamine, and 4,4'-diaminodiphenylmethane; alicyclic diamines, such as 4,4'-diamino-3,3'-dimethyldicyclohexylmethane, diaminocyclohexane, and isophoronediamine; aliphatic diamines, such as ethylene diamine, tetramethylene diamine, and hexamethylenediamine; trivalent or higher valent amines, such as diethylene triamine and triethylene tetramine; amino alcohols, such as ethanol amine and hydroxyethyl aniline; aminomercaptans, such as aminoethylmercaptan and aminopropylmercaptan; amino acids, such as amino propionic acid and amino caproic acid; ketamine compounds obtained by blocking amino groups of the above-listed amines with ketones (e.g., acetone, methyl ethyl ketone, and methyl isobutyl ketone); and oxazoline compounds. These may be used alone or in combination. Among them, diamine, and a mixture of diamine and a small amount of trivalent or higher valent amine are preferable.

<Plate-Shaped Pigment>

The pigment used in the present disclosure has a plate shape. The pigment is preferably a metal pigment for efficiently reflecting light. Examples of the metal pigment include, but are not limited to: powder of metals, such as aluminium, brass, bronze, nickel, stainless steel, zinc, copper, silver, gold, and platinum; and flaky glass powder on which a metal is vapor-deposited. Among them, aluminium is preferable because aluminium has a high reflectance to light and does not decrease in the reflectance due to oxidation so much. The surface of the plate-shaped pigment is preferably subjected to a surface treatment in terms of dispersibility and antifouling property. The plate-shaped pigment may be coated with, for example, various surface treatment agents, a silane coupling agent, a titanate-based coupling agent, a fatty acid, silica particles, an acrylic resin, and polyester resin.

Figure 2:
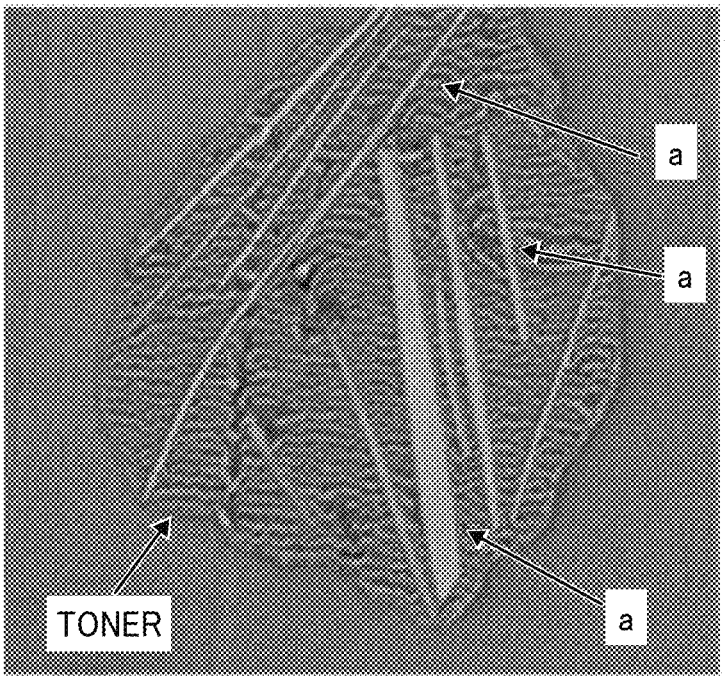
FIG. 2 is an electron micrograph of one example of a toner particle of the present disclosure.

FIG. 2 is a micrograph of a cross-section of one example of the toner of the present disclosure containing plate-shaped pigment particles a.

The plate-shaped pigment may be scaly (plate-shaped) or flat to have a light-reflection surface. The plate-shaped pigment that is scaly or flat can develop glittering property. The plate-shaped pigment may be used alone or in combination of two or more. For adjustment of a color tone, the plate-shaped pigment may be used in combination with various colorants such as a dye and a pigment.

The amount of the plate-shaped pigment is preferably from 5% by mass through 50% by mass relative to the total mass of the toner.

<Circularity of Toner>

The toner of the present disclosure preferably has a circularity of 0.950 or greater but 0.985 or smaller.

When the circularity of the toner is high in the certain range (i.e., the shape of the toner is round), the plate-shaped pigment particles can exist in the toner at a distance from each other. As a result, it is possible to prevent the plate-shaped pigment particles from coming close to or coming into contact with each other in a fixed image, resulting in suppressing exfoliation of the fixed image.

The toner having a circularity of 0.950 or greater can prevent glittering plate-shaped pigment particles from coming close to or coming into contact with each other. As a result, exfoliation of the fixed image does not occur. The toner having a circularity of 0.985 or smaller has a good cleaning performance because cleaning with a blade is successfully performed. As a result, a streaky abnormal image is not formed. The abnormal image is not flat at the image surface, easily causing image exfoliation.

As used herein, "circularity" refers to an average circularity as measured with a flow-type particle image analyzer FPIA-3000 (trade name) (available from SYSMEX CORPORATION). Specifically, from 0.1 mL through 0.5 mL of a surfactant, preferably alkylbenzene sulfonate, serving as a dispersant is added to a vessel containing from 100 mL through 150 mL of water from which solid impurities have been removed in advance. From about 0.1 g through about 0.5 g of a measurement sample (toner) is added to the vessel to prepare a suspension liquid where the toner is dispersed. The suspension liquid is subjected to a dispersion treatment for from about 1 minute through about 3 minutes with an ultrasonic disperser so that the concentration of the dispersion liquid is to be from 3,000 particles/μL through 10,000 particles/μL. The resultant dispersion liquid is set in the above-described analyzer and is measured for the shape and distribution of the toner to determine the circularity.

To obtain a substantially spherical toner having the desired circularity defined in the present disclosure, the following methods are effective.

(1) Adjusting Method 1 for the Toner Shape and the Intervals Between the Plate-Shaped Pigment Particles A preferable toner producing method includes a step of dispersing in an aqueous medium an organic liquid containing the plate-shaped pigment particles and a substance that exhibits a state of being a needle shape or a plate shape, or both shapes, to prepare an oil-in-water (O/W type) emulsion. Once oil droplets have been formed in the aqueous medium, the plate-shaped pigment particles can freely move in the oil droplets to prevent the plate-shaped pigment particles from being aligned in the same direction. The oil droplets will then become toner particles to form a toner where the plate-shaped pigment particles and the other needle- or plate-shaped substances are immobilized in the same states as in the oil droplets. As a result, the toner can be prevented from having a flat shape.

A specific toner producing method for performing the above method is suitably a dissolution suspension method including dissolving a resin for toner and a colorant in an organic solvent and dispersing the resultant solution to form oil droplets, and a suspension polymerization method using radical-polymerizable monomers.

(2) Adjusting Method 2 for the Toner Shape

During the production of the toner, the flat shape of toner particles can be corrected by reducing the viscosity of the toner in the aqueous medium and giving a shearing force to the toner then. The shearing force may be given to the dispersion liquid in the course of solvent removal in the dissolution suspension method or in the course of ongoing polymerization conversion in the suspension polymerization method, to adjust the particle shape from an elliptical shape to a substantially circular shape.

(3) Adjusting Method 3 for the Toner Shape

The viscoelasticity of the toner surface may be increased when the plate-shaped pigment particles are wrapped with, for example, the resin.

A reactive functional group may be preferentially disposed on the toner surface to cause polymerization and cross-linking reaction.

During the production of the toner, for example, different substances that cause reaction at the interfaces between the oil droplets in the aqueous medium and the aqueous medium are allowed to be present. The reactive prepolymer is contained on the oil droplet side, and a substance reactive with the prepolymer is contained on the aqueous medium side.

It is also effective to dispose solid particles on the toner surface in order to keep the viscoelasticity of the surface high. For example, organically modified inorganic particles that tend to orient at the oil-water interface may be contained in the oil droplets. Examples of the organically modified inorganic particles include, but are not limited to, organically modified bentonite, organically modified montmorillonite, and organic solvent dispersible colloidal silica.

—Other Materials—

As long as the effects of the present disclosure are not impaired, the toner of the present disclosure may include not only the binder resin but also other resins and other components such as a colorant, wax, a charge-controlling agent, an external additive, a flowability enhancer, a cleanability enhancer, and a magnetic material, according to the necessity.

The other resins are not particularly limited and may be appropriately selected from resins known in the art depending on the intended purpose. Examples of the other resins include, but are not limited to: homopolymers of styrene or substituted styrene, such as polystyrene, poly(p-styrene), and polyvinyl toluene; styrene-based copolymers, such as styrene-p-chlorostyrene copolymer, styrene-propylene copolymer, styrene-vinyl toluene copolymer, styrene-methyl acrylate copolymer, styrene-ethyl acrylate copolymer, styrene-methacrylic acid copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-methyl vinyl ketone copolymer, styrene-butadiene copolymer, styrene-isopropyl copolymer, and styrene-maleic acid ester copolymer; a polymethyl methacrylate resin; a polybutyl methacrylate resin; a polyvinyl chloride resin; a polyvinyl acetate resin; a polyethylene resin; a polyester resin; a polyurethane resin; an epoxy resin; a polyvinyl butyral resin; a polyacrylic acid resin; a rosin resin; a modified rosin resin; a terpene resin; a phenol resin; an aliphatic or aromatic hydrocarbon resin; an aromatic-based petroleum resin, and resins modified to have a functional group reactive with an active hydrogen group. These may be used alone or in combination.

From the viewpoint of controlling the glass transition temperature and the storage elastic modulus of the toner of the present disclosure to particularly preferable values, the other resins are particularly preferably resins compatible with the polyester resin (A), particularly preferably polyester resin (B). When the resin compatible with the polyester resin (A) is present in the cross-linked structure of the polyester resin (A) having high rubber elasticity, a toner having very excellent melting ability in a fixing temperature region can be obtained even through the toner has a high-order cross-linked structure.

The glass transition temperature of the compatible polyester resin (B) is preferably 30° C. or higher but 80° C. or lower, more preferably 40° C. or higher but 75° C. or lower, from the viewpoint of controlling the glass transition temperature of the toner.

The compatible polyester resin is preferably a linear or non-linear polyester resin that can be dissolved in THF and is preferably an unmodified polyester resin. The unmodified polyester resin is a polyester resin obtained using polyvalent alcohol and polyvalent carboxylic acid or a derivative thereof (e.g., polyvalent carboxylic acid, polyvalent carboxylic acid anhydride, and polyvalent carboxylic acid ester), where the polyester resin is not modified with, for example, an isocyanate compound.

Examples of the polyvalent alcohol include, but are not limited to: alkylene (the number of carbon atoms: 2 or 3) oxide adducts (the average number of moles added: from 1 through 10) of bisphenol (A) (e.g., polyoxypropyl ene(2.2)-2,2-bis(4-hydroxyphenyl)propane and polyoxyethylene (2.2)-2,2-bis(4-hydroxyphenyl)propane); ethylene glycol, propylene glycol; diol, such as hydrogenated bisphenol A, and alkylene (the number of carbon atoms: 2 or 3) oxide adduct (the average number of moles added: from 1 through 10) of hydrogenated bisphenol A; and trivalent or higher valent alcohol, such as glycerin, pentaerythritol, and trimethylolpropane. These may be used alone or in combination.

Examples of the polyvalent carboxylic acid include, but are not limited to: dicarboxylic acid, such as adipic acid, phthalic acid, isophthalic acid, terephthalic acid, fumaric acid, maleic acid, and succinic acid substituted with an alkyl group having from 1 through 20 carbon atoms or an alkenyl group having from 2 through 20 carbon atoms (e.g., dodecenylsuccinic acid and octylsuccinic acid); and trivalent or higher valent carboxylic acid, such as trimellitic acid, pyromellitic acid, and acid anhydrides thereof. These may be used alone or in combination.

The molecular weight of the polyester resin (B) is not particularly limited. When the molecular weight of the polyester resin (B) is too low, the resultant toner may be poor in heat resistant storage stability, chargeability, and mechanical durability to stress such as stirring in a developing device. When the molecular weight of the polyester resin (B) is too high, the resultant toner may be poor in low-temperature fixability due to the increased viscoelasticity upon melting of the toner. The weight average molecular weight (Mw) of the polyester resin (B) as determined by gel permeation chromatography (GPC) is preferably from 5,000 through 20,000, more preferably from 7,000 through 12,000. The number average molecular weight (Mn) of the polyester resin (B) is preferably from 1,000 through 4,000, more preferably from 1,500 through 3,000. The Mw/Mn of the polyester resin (B) is preferably from 1.0 through 4.0, more preferably from 1.0 through 3.5.

The acid value of the polyester resin is not particularly limited but is preferably from 1 mgKOH/g through 50 mgKOH/g, more preferably from 5 mgKOH/g through 30 mgKOH/g. Since the acid value of the polyester resin is 1 mgKOH/g or greater, the resultant toner tends to be negatively charged, and moreover affinity between paper and the toner is improved to achieve excellent fixability. When the acid value of the polyester resin is greater than 50 mgKOH/g, charging stability, particularly charging stability to changes in the environment, may be degraded.

The hydroxyl value of the polyester resin is not particularly limited but is preferably 5 mgKOH/g or greater.

The toner may include a crystalline resin as the other resins.

The crystalline resin is preferably a crystalline resin that melts at a temperature near a fixing temperature. When included in the toner, such a crystalline resin becomes compatible to the binder resin as the crystalline resin melts at a fixing temperature, enhancing sharp melt properties of the toner and contributing greatly to low-temperature fixability.

The crystalline resin is not particularly limited and may be appropriately selected depending on the intended purpose as long as the crystalline resin is a resin having crystallinity. Examples of the crystalline resin include a polyester resin, a polyurethane resin, a polyurea resin, a polyamide resin, a polyether resin, a vinyl resin, and a modified crystalline resin. These may be used alone or in combination.

The melting point of the crystalline resin is not particularly limited but is preferably 60° C. or higher but 100° C. or lower. When the melting point of the crystalline resin is lower than 60° C., the crystalline resin easily starts to melt at low temperatures, potentially resulting in decrease in the heat resistant storage stability of the toner. When the melting point of the crystalline resin is higher than 100° C., the crystalline resin does not contribute to the low-temperature fixability so much.

The molecular weight of the crystalline polyester resin is not particularly limited. The orthodichlorobenzene-soluble component of the crystalline polyester resin as determined by GPC preferably has a weight average molecular weight (Mw) of from 3,000 through 30,000, a number average molecular weight (Mn) of from 1,000 through 10,000, and a Mw/Mn of from 1.0 through 10. More preferably, the weight average molecular weight (Mw) is from 5,000 through 15,000, the number average molecular weight (Mn) is from 2,000 through 10,000, and the Mw/Mn is from 1.0 through 5.0. When the weight average molecular weight and the number average molecular weight are too low, the resultant toner may be degraded in heat resistant storage stability. When these are too high, the crystalline polyester resin contributes to the low-temperature fixability to a low extent. When the Mw/Mn is higher than 5.0, the crystalline polyester resin cannot provide the toner with sufficient sharp melt properties in some cases.

The acid value of the crystalline polyester resin is not particularly limited but is preferably 5 mgKOH/g or greater, more preferably 10 mgKOH/g or greater, to achieve desired low-temperature fixability in view of affinity between paper and the resin. To improve hot offset resistance, on the other hand, the acid value of the crystalline polyester resin is preferably 45 mgKOH/g or less.

The hydroxyl value of the crystalline polyester resin is not particularly limited but is preferably from 0 mgKOH/g through 50 mgKOH/g, more preferably from 5 mgKOH/g through 50 mgKOH/g, to achieve desired low-temperature fixability and excellent chargeability.

The amount of the crystalline polyester resin in the toner is not particularly limited but is preferably from 3 parts by mass through 20 parts by mass, more preferably from 5 parts by mass through 15 parts by mass, relative to 100 parts by mass of the toner. When the amount of the crystalline polyester resin in the toner is less than 3 parts by mass, the crystalline polyester resin contributes to the low-temperature fixability to a low extent. When the amount of the crystalline polyester resin is greater than 20 parts by mass, the resultant toner may be degraded in the heat resistant storage stability, mechanical durability, and abrasion resistance.

<<Wax>>

The wax is not particularly limited and may be appropriately selected from wax known in the art depending on the intended purpose.

Wax used for preventing stacking of the plate-shaped pigment particles and extending the intervals between the planes of the plate-shaped pigment particles is preferably wax that is produced so as to be branched and have a polar group in the course of the production in order to have a certain degree of polarity. The melting point of the wax may be the same extent as the melting temperature of the resin used in the toner. Alternatively, the melting point of the wax may be high as long as it is equal to or lower than the temperature of an image on paper upon fixing.

Examples of the polar group include, but are not limited to, a hydroxyl group, a carboxyl group, an amide group, and an amino group. These polar groups can be introduced into the wax to form modified wax. Examples of other modified wax include, but are not limited to: oxidized modified wax that is obtained by oxidizing a hydrocarbon by the air oxidation method; salts of the oxidized modified wax with metals such as potassium and sodium; polymers containing an acid group, such as copolymers between alpha olefins and copolymers of maleic anhydrides, salts, imide esters, and quaternary amine salts thereof; and products obtained by alkoxylating a hydrocarbon modified with a hydroxyl group.

Examples of the wax in the present disclosure include, but are not limited to, carbonyl group-containing wax, polyolefin wax, and long-chain hydrocarbon wax. Examples of esterified products of the carbonyl group-containing wax include, but are not limited to, polyalkanoic acid esters, polyalkanol esters, polyalkanoic acid amides, polyalkyl amides, and dialkyl ketones.

Examples of the polyalkanoic acid ester-based wax include, but are not limited to, carnauba wax, montan wax, trimethylolpropane tribehenate, pentaerythritol tetrabehenate, pentaerythritol diacetate dibehenate, glycerin tribehenate, and 1,18-octadecanediol distearate.

Examples of the polyalkanol esters include, but are not limited to, tristearyl trimellitate and distearyl maleate.

Examples of the polyalkanoic acid amides include, but are not limited to, dibehenyl amide.

Examples of the polyalkyl amides include, but are not limited to, tristearylamide trimellitate.

Examples of the dialkyl ketones include, but are not limited to, distearyl ketone. Among the above carbonyl group-containing wax, polyalkanoic acid esters are particularly preferable.

Examples of the polyolefin was include, but are not limited to, polyethylene wax and polypropylene wax.

Examples of the long-chain hydrocarbon wax include, but are not limited to, paraffin wax and Sasol wax.

The melting point of the wax is not particularly limited and may be appropriately selected depending on the intended purpose. The melting point of the wax is preferably from 50° C. through 100° C., more preferably from 60° C. through 90° C. When the melting point of the wax is 50° C. or higher, the heat resistant storage stability can be favorably maintained. When the melting point of the wax is 100° C. or lower, cold offset upon fixing at low temperatures does not occur.

The melting point of the wax can be measured using, for example, a differential scanning calorimeter (TA-60WS and DSC-60 (available from Shimadzu Corporation)). Specifically, 5.0 mg of wax is placed in an aluminium sample container, the sample container is placed on a holder unit, and the holder unit is set in an electric furnace. Measurement is performed by heating the sample from 0° C. to 150° C. at a heating speed of 10° C./min in a nitrogen atmosphere. Next, the sample is cooled from 150° C. to 0° C. at a cooling speed of 10° C./min and is again heated to 150° C. at a heating speed of 10° C./min, to obtain DSC curves. The obtained DSC curves can be analyzed using the analysis program installed in the DSC-60 system to determine the maximum peak temperature in heat of melting at the second heating as the melting point.

The melt viscosity of the wax is preferably from 5 mPa·sec through 100 mPa·sec as a measurement at 100° C., more preferably from 5 mPa·sec through 50 mPa·sec, particularly preferably from 5 mPa·sec through 20 mPa·sec. When the melt viscosity of the wax is 5 mPa·sec or higher, deterioration in releasability can be prevented. When the melt viscosity is 100 mPa·sec or lower, deterioration in hot offset resistance and releasability at low temperatures can be effectively prevented.

The total proportion of the wax, including wax processed into a needle- or plate-shaped substance and other wax contained in the toner, is preferably from 1% by mass through 30% by mass, more preferably from 5% by mass through 10% by mass, relative to the toner. When the total proportion of the wax is 5% by mass or more, deterioration of the toner in hot offset resistance can be effectively prevented. When the total proportion of the wax is 10% by mass or less, deterioration of the toner in heat resistant storage stability, chargeability, transferability, and stress resistance can be effectively prevented.

The proportion of the wax as the needle- or plate-shaped substance is preferably from 1% by mass through 30% by mass, more preferably from 5% by mass through 10% by mass, relative to the plate-shaped pigment.

<<Colorant>>

The colorant that can be used in combination with the plate-shaped pigment is not particularly limited and may be appropriately selected from known colorants depending on the intended purpose.

Examples of a colorant for black include, but are not limited to: carbon black (C.I. Pigment Black 7) such as Furnace black, Lamp black, Acetylene black, and Channel black; metals such as copper, iron (C.I. Pigment Black 11), and titanium oxide; and organic pigments such as aniline black (C.I. Pigment Black 1).

Examples of a pigment for magenta include, but are not limited to: C.I. Pigment Red series (1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 150, 163, 177, 179, 184, 202, 206, 207, 209, 211, and 269); Pigment Violet 19; and C.I. Vat Red series (1, 2, 10, 13, 15, 23, 29, and 35).

Examples of a pigment for cyan include, but are not limited to: C.I. Pigment Blue series (2, 3, 15, 15:1, 15:2, 15:3, 15:4, 15:6, 16, 17, and 60); C.I. Vat Blue 6; C.I. Acid Blue 45; copper phthalocyanine pigments having a phthalocyanine skeleton substituted with from 1 through 5 of phthalimidomethyl groups; Green 7; and Green 36.

Examples of a pigment for yellow include, but are not limited to: C.I. Pigment Yellow series (1, 2, 3, 4, 5, 6, 7, 10, 11, 12, 13, 14, 15, 16, 17, 23, 55, 65, 73, 74, 83, 97, 110, 139, 151, 154, 155, 180, and 185); C.I. Vat Yellow series (1, 3, and 20); and Orange 36.

The proportion of the colorant in the toner is preferably from 1% by mass through 15% by mass, more preferably from 3% by mass through 10% by mass. When the proportion of the colorant is 1% by mass or more, reduction in coloring power of the toner can be prevented. When the proportion of the colorant is 15% by mass or less, poor dispersion of the pigment in the toner can be prevented, which makes it possible to effectively prevent problems such as decrease in coloring power and deterioration in electrical properties of the toner.

The colorant may be used as a master batch together with a resin. The resin is not particularly limited, but use of a binder resin or a resin having the similar structure to the structure of the binder resin is preferable in terms of compatibility with the binder resin.

The master batch can be produced by mixing or kneading the resin and the colorant under application of a high shearing force. At this time, an organic solvent is preferably added to increase interactions between the colorant and the resin. A so-called flashing method is preferable because a wet cake of the colorant can be used as it is, which requires no drying. The flashing method is a method of removing water and an organic solvent by mixing or kneading a water-containing aqueous paste of the colorant with the resin and the organic solvent to transfer the colorant to the resin side. A high-shearing disperser such as a three-roll mill can be used for mixing and kneading.

<<Charge Controlling Agent>>

In order to give appropriate chargeability to a toner, the toner may contain a charge controlling agent, if necessary.

The charge controlling agent may be any known charge controlling agent. Inclusion of a colored material in the charge controlling agent may change the color tone of the toner. Therefore, the charge controlling agent is preferably a colorless material or a nearly white material. Examples of the charge controlling agent include, but are not limited to, triphenylmethane dyes, molybdic acid chelate pigments, rhodamine dyes, alkoxy-based amines, quaternary ammonium salts (including fluorine-modified quaternary ammonium salts), alkylamides, phosphorus or phosphorus compounds, tungsten or tungsten compounds, fluorine active agents, metal salts of salicylic acid, and metal salts of salicylic acid derivatives. These may be used alone or in combination.

The amount of the charging-controlling agent is not flatly determined because it is determined depending on the kind of the binder resin and the toner production method including a dispersion method. The proportion of the charging-controlling agent is preferably from 0.01% by mass through 5% by mass, more preferably from 0.02% by mass through 2% by mass, relative to the binder resin. When the proportion of the charging-controlling agent is 5% by mass or less, chargeability of the toner does not become too large. The charge controlling agent can exhibit its effects to reduce the electrostatic attraction force with the developing roller, which makes it possible to effectively prevent decrease in flowability of the developer and in the image density. When the proportion of the charging-controlling agent is 0.01% by mass or more, a sufficient charge-rising property and a sufficient amount of charges are achieved.

<<External Additive>>

Various external additives can be added to the toner for the purpose of, for example, modifying flowability, adjusting the amount of charges, and adjusting electric properties. Examples of the external additive include, but are not limited to: silica particles, hydrophobized silica particles, fatty acid metal salts (e.g., zinc stearate and aluminum stearate); metal oxides (e.g., titania, alumina, tin oxide, and antimony oxide) and hydrophobized products thereof, and fluoropolymers. Among them, hydrophobized silica particles, titania particles, and hydrophobized titania particles are preferable.

Examples of the hydrophobized silica particles include, but are not limited to: HDK H2000, HDK H2000/4, HDK H2050EP, HVK21, and HDK H1303 (all of which are available from Hoechst, AG); and R972, R974, RX200, RY200, R202, R805, and R812 (all of which are available from NIPPON AEROSIL CO., LTD.). Examples of the titania particles include, but are not limited to: P-25 (available from NIPPON AEROSIL CO., LTD.); STT-30 and STT-65CS (both of which are available from Titan Kogyo, Ltd.); TAF-140 (available from Fuji Titanium Industry Co., Ltd.); MT-150 W, MT-500B, MT-600B, and MT-150A (all of which are available from TAYCA CORPORATION). Examples of the hydrophobized titania particles include, but are not limited to: T-805 (available from NIPPON AEROSIL CO., LTD.); STT-30A and STT-65S-S (both of which are available from Titan Kogyo, Ltd.); TAF-500T and TAF-1500T (both of which are available from Fuji Titanium Industry Co., Ltd.); MT-100S and MT-100T (both of which are available from TAYCA CORPORATION); and IT-S (available from ISHIHARA SANGYO KAISHA, LTD.).

The hydrophobized silica particles, the hydrophobized titania particles, and the hydrophobized alumina particles can be obtained by treating hydrophilic particles with a silane coupling agent such as methyltrimethoxysilane, methyltriethoxysilane, and octyltrimethoxysilane. Examples of the hydrophobic treatment agent include, but are not limited to: silane coupling agents, such as dialkyl dihalogenated silane, trialkyl halogenated silane, alkyl trihalogenated silane, and hexaalkyldisilazane; silylating agents; silane coupling agents having a fluorinated alkyl group; organic titanate-based coupling agents; aluminum-based coupling agents; silicone oil; and silicone varnish.

The average particle diameter of primary particles of the external additive is preferably from 1 nm through 100 nm, more preferably from 3 nm through 70 nm. When the average particle diameter of the primary particles is 1 nm or more, it is possible to effectively prevent such a problem that the external additive is embedded in the toner to raise a difficulty in effectively exhibiting its functions. When the average particle diameter of the primary particles is 100 nm or less, it is possible to effectively prevent such a problem that the surface of a photoconductor is unevenly damaged. The external additive can be used in combination with inorganic particles and hydrophobically treated inorganic particles. However, at least two or more kinds of hydrophobically treated inorganic particles of the primary particles having an average particle diameter of 20 nm or less are preferably included, and at least one or more kinds of the inorganic particles having an average particle diameter of 30 nm or more is more preferably included. The specific surface area of the inorganic particles determined by the BET method is preferably from 20 $m^2/g$ through 500 $m^2/g$.

The amount of the external additive is preferably from 0.1% by mass through 5% by mass, more preferably from 0.3% by mass through 3% by mass, relative to the toner.

Resin particles may also be added as the external additive. Examples of the resin particles include, but are not limited to: polystyrene obtained by soap-free emulsion polymerization, suspension polymerization, or dispersion polymerization; copolymers of methacrylic acid esters or acrylic acid esters; polycondensation-based compounds, such as silicone, benzoguanamine, and NYLON; and polymer particles of thermosetting resins. Use of such resin particles in combination can enhance chargeability of a toner, and reduce oppositely charged toner particles to suppress background fog.

The amount of the resin particles is preferably from 0.01% by mass through 5% by mass, more preferably from 0.1% by mass through 2% by mass, relative to the toner.

<Production Method of Toner>

For a production method of the toner and materials to be used, known methods and materials can be appropriately used as long as the above-described requirements defined in the present disclosure can be satisfied. Examples of the production method of the toner of the present disclosure include, but are not limited to, a kneading and pulverization method, and a chemical process in which toner particles are formed in an aqueous medium.

However, a suitable production method that particularly realizes the above-described requirements is a dissolution suspension method in which a resin for toner or a colorant is dissolved in an organic solvent and is dispersed to form oil droplets, and a suspension polymerization method using radically polymerizable monomers.

A more preferable producing method is, for example, a toner producing method including a step of dispersing in an aqueous medium an organic liquid containing the plate-shaped pigment particles and if necessary a substance that exhibits a state of being a needle shape or a plate shape, or both shapes, to prepare an oil-in-water (O/W type) emulsion. Once oil droplets have been formed in the aqueous medium, the plate-shaped pigment particles and the other needle- and plate-shaped particles can freely move in the oil droplets to prevent the plate-shaped pigment particles from being aligned in the same direction. The oil droplets will then become toner particles to form a toner where the plate-shaped pigment particles and the other needle- or plate-shaped substances are immobilized in the same states as in the oil droplets.

<<Dissolution Suspension Method and Suspension Polymerization Method>>

The dissolution suspension method is, for example, a method in which a toner composition including at least a binder resin or a resin precursor, a colorant, and wax is dissolved or dispersed in an organic solvent to prepare an oil-phase composition, and the oil-phase composition is dispersed or emulsified in an aqueous medium, to produce toner base particles.

An organic solvent used for dissolving or dispersing the toner composition is preferably a volatile organic solvent having a boiling point of lower than 100° C. because the subsequent removal of the solvent is easy.

Examples of the organic solvent include, but are not limited to: ester or ester ether solvents, such as ethyl acetate, butyl acetate, methoxybutyl acetate, methyl cellosolve acetate, and ethyl cellosolve acetate; ether solvents, such as diethyl ether, tetrahydrofuran, dioxane, ethyl cellosolve, butyl cellosolve, and propylene glycol monomethyl ether; ketone solvents, such as acetone, methyl ethyl ketone, methyl isobutyl ketone, di-n-butyl ketone, and cyclohexanone; alcohol solvents, such as methanol, ethanol, n-propanol, isopropanol, n-butanol, isobutanol, t-butanol, 2-ethylhexylalcohol, and benzyl alcohol; and mixture solvents of two or more solvents described above.

In the dissolution suspension method, an emulsifier or a dispersant may be used if necessary in order to disperse or emulsify an oil-phase composition in an aqueous medium.

Examples of the emulsifier or the dispersant include, but are not limited to, known surfactants and known water-soluble polymers. The surfactant is not particularly limited. Examples of the surfactant include, but are not limited to: anionic surfactants (e.g., alkyl benzene sulfonic acid and phosphoric acid esters); cationic surfactants (e.g., quaternary ammonium salt type and amine salt type); amphoteric surfactants (e.g., carboxylic acid salt type, sulfuric acid ester salt type, sulfonic acid salt type, and phosphoric acid ester type); and nonionic surfactants (e.g., AO-added type and polyvalent alcohol type).

These surfactants may be used alone or in combination.

Examples of the water-soluble polymer include, but are not limited to, cellulose compounds (e.g., methyl cellulose, ethyl cellulose, hydroxyethyl cellulose, ethylhydroxyethyl cellulose, carboxy methyl cellulose, hydroxypropyl cellulose, and saponified compounds thereof), gelatin, starch, dextrin, Gum arabic, chitin, chitosan, polyvinyl alcohol, polyvinyl pyrrolidone, polyethylene glycol, polyethylene imine, polyacrylamide, acrylic acid (salt)-containing polymers (e.g., sodium polyacrylate, potassium polyacrylate, ammonium polyacrylate, partially neutralized products of polyacrylic acid with sodium hydroxide, and sodium acrylate-acrylic acid ester copolymers), (partially) neutralized products of styrene-maleic anhydride copolymer with sodium hydroxide, and water-soluble polyurethanes (e.g., reaction products of polyisocyanate with, for example, polyethylene glycol or polycaprolactone diol).

The above organic solvent, a plasticizer, and other substances may also be used as an auxiliary agent for emulsification or dispersion.

The toner is preferably obtained from toner base particles formed by the dissolution suspension method in which an oil-phase composition containing a binder resin, a binder resin precursor containing a group reactive with an active hydrogen group (a reactive group-containing prepolymer), a colorant, and wax is dispersed or emulsified in an aqueous medium containing resin particles, to cause reaction between the reactive group-containing prepolymer and an active hydrogen group-containing compound contained in at least one of the oil-phase composition and the aqueous medium.

The resin particles can be formed by any known polymerization method, but is preferably obtained as an aqueous dispersion liquid of the resin particles.

Examples of a method for preparing an aqueous dispersion liquid of the resin particles include, but are not limited to, methods (a) to (h) below.

(a) A method in which a vinyl monomer as a starting material is allowed to polymerize by the suspension polymerization method, the emulsification polymerization method, the seed polymerization method, or the dispersion polymerization method, to directly prepare an aqueous dispersion liquid of resin particles.

(b) A method in which a precursor (e.g., a monomer or an oligomer) of a polyaddition or condensation resin (e.g., a polyester resin, a polyurethane resin, or an epoxy resin) or a solvent solution thereof is dispersed in an aqueous medium in the presence of a suitable dispersant, and then the resultant dispersion is cured under heating or by the addition of a curing agent, to prepare an aqueous dispersion liquid of resin particles.

(c) A method in which an appropriate emulsifier is dissolved in a precursor (e g, a monomer or an oligomer) of a polyaddition or condensation resin (e.g., a polyester resin, a polyurethane resin, or an epoxy resin) or a solvent solution thereof (which is preferably liquid or may be heated for liquefaction), and the resultant solution is allowed to undergo phase-transfer emulsification by the addition of water, to thereby prepare an aqueous dispersion liquid of resin particles.

(d) A method in which a resin that has previously been synthesized through polymerization reaction (e.g., addition polymerization, ring-opening polymerization, polyaddition, addition condensation, or condensation polymerization) is pulverized using a mechanical-rotation-type or jet-type pulverizing mill, followed by classification to obtain resin particles, and then the resin particles are dispersed in water in the presence of a suitable dispersant, to prepare an aqueous dispersion liquid of the resin particles.

(e) A method in which a resin that has previously been synthesized through polymerization reaction (e.g., addition polymerization, ring-opening polymerization, polyaddition, addition condensation, or condensation polymerization) is dissolved in a solvent to prepare a resin solution, the resin solution is sprayed in the form of mist to form resin particles, and then the resin particles are dispersed in water in the presence of a suitable dispersant, to prepare an aqueous dispersion liquid of the resin particles.

(f) A method in which a resin that has previously been synthesized through polymerization reaction (e.g., addition polymerization, ring-opening polymerization, polyaddition, addition condensation, or condensation polymerization) is dissolved in a solvent to prepare a resin solution, then a poor solvent is added to the resin solution or the resin solution is dissolved in a solvent under heating, followed by cooling to precipitate resin particles, the solvent is removed to obtain resin particles, and then the resin particles are dispersed in water in the presence of a suitable dispersant, to prepare an aqueous dispersion liquid of the resin particles.

(g) A method in which a resin that has previously been synthesized through polymerization (e.g., addition polymerization, ring-opening polymerization, polyaddition, addition condensation, or condensation polymerization) is dissolved in a solvent to prepare a resin solution, the resin solution is dispersed in an aqueous medium in the presence of a suitable dispersant, and the solvent is removed through heating or under reduced pressure, to prepare an aqueous dispersion liquid of resin particles.

(h) A method in which a resin that has previously been synthesized through polymerization (e.g., addition polymerization, ring-opening polymerization, polyaddition, addition condensation, or condensation polymerization) is dissolved in a solvent to prepare a resin solution, an appropriate emulsifier is dissolved in the resin solution, and then the resultant solution is allowed to undergo phase-transfer emulsification by the addition of water, to prepare an aqueous dispersion liquid of resin particles.

The volume average particle diameter of the resin particles is preferably 10 nm or greater but 300 nm or less, more preferably 30 nm or greater but 120 nm or less. When the volume average particle diameter of the resin particles is 10 nm or greater but 300 nm or less, deterioration in the particle size distribution of the toner can be effectively prevented.

The solid content concentration of the oil phase is preferably from 40% through 80%. When the solid content concentration of the oil phase is too high, dissolution or dispersion of the oil phase is difficult, and the viscosity becomes high, resulting in difficulty in handling. When the solid content concentration of the oil phase is too low, productivity of the toner decreases.

A toner composition other than the binder resin such as the colorant and the wax and a master batch thereof may each individually be dissolved or dispersed in an organic solvent, and then may be mixed with a solution or dispersion of the binder resin.

As the aqueous medium, water may be used alone, or a solvent that is miscible with water may be used in combination. Examples of the solvent that is miscible with water include, but are not limited to, alcohols (e.g., methanol, isopropanol, and ethylene glycol), dimethyl formamide, tetrahydrofuran, cellosolves (e.g., methyl cellosolve), and lower ketones (e.g., acetone and methyl ethyl ketone).

A method for dispersing or emulsifying the oil phase in the aqueous medium is not particularly limited. Examples of the method for dispersing or emulsifying the oil phase in the aqueous medium include known devices such as a low-speed shearing disperser, a high-speed shearing disperser, a friction disperser, a high-pressure jetting disperser, and an ultrasonic disperser. Among them, a high-speed shearing disperser is preferable from the viewpoint of making the particle diameter smaller. When a high-speed shearing disperser is used, the rotating speed of the high-speed shearing disperser is not particularly limited but is preferably in the range of from 1,000 rpm through 30,000 rpm, more preferably in the range of from 5,000 rpm through 20,000 rpm. The temperature at the time of dispersing using the high-speed shearing disperser is generally from 0° C. through 150° C. (under pressurization), preferably from 20° C. through 80° C.

A method for removing the organic solvent from the obtained emulsified dispersion is not particularly limited and may be any known method. One employable method is gradually increasing the temperature of the entire system at normal pressure or reduced pressure under stirring to completely evaporate and remove the organic solvent in droplets.

As a method for washing and drying toner base particles dispersed in an aqueous medium, known techniques can be used. Specifically, after solid-liquid separation with a centrifugal separator or a filter press, the obtained toner cake is re-dispersed in ion-exchanged water having a temperature of from normal temperature through about 40° C. If necessary, the pH of the solution is adjusted with an acid or an alkaline before performing solid-liquid separation again. This step is repeated several times to remove, for example, impurities and the surfactant. The resultant is dried using, for example, a flash dryer, a circulation dryer, a vacuum dryer, or a vibrant fluidized dryer, to obtain toner powder. At this time, unwanted toner particles having small particle diameters may be removed through, for example, centrifugation. Alternatively, if necessary, a known classifier may be used after drying to achieve a desired particle size distribution.

The suspension polymerization method is a method in which a radically polymerizable monomer and a polymerization initiator are used instead of the organic solvent to prepare an oil phase, and the oil phase is emulsified in the same manner to prepare oil droplets, followed by polymerization reaction with, for example, heat. The radically polymerizable monomer is preferably styrene, an acrylic acid ester, and a methacrylic acid ester-based monomer. An azo-based initiator or a peroxide-based initiator is selected as the polymerization initiator. In the suspension polymerization method, a step of removing the organic solvent is not needed.

To increase flowability, storage stability, developability, and transferability of the toner, inorganic particles such as hydrophobic silica powder may further be added to and mixed with the toner base particles produced in the above-described manner.

A commonly-used powder mixer is used to mix additives, and is preferably adjustable in its inner temperature with, for example, a jacket provided to the mixer. The additives may be added gradually or in the course of the mixing to change the history of the load applied to the additives. In this case, the number of rotations, rolling speed, time, and temperature of the mixer may be changed. Alternatively, a large load may be initially applied to the additive and next a relatively small load may be applied thereto, and vice versa. Examples of usable mixing devices include, but are not limited to, a V-type mixer, a Rocking mixer, a Loedige mixer, a Nauta mixer, and a Henschel mixer. The resultant mixture is allowed to pass through a sieve of 250 mesh or finer, and thus coarse particles and aggregation particles are removed to obtain the toner.

(Developer)

A developer of the present disclosure includes the toner and if necessary appropriately selected other components such as a carrier.

The developer of the present disclosure is excellent in transferability and chargeability and can stably form high-quality images. The developer may be a one-component developer or a two-component developer.

When used in a two-component developer, the toner may be mixed with a carrier. The amount of the carrier in the two-component developer is not particularly limited and may be appropriately selected depending on the intended purpose. The proportion of the carrier in the two-component developer is preferably from 90% by mass through 98% by mass, more preferably from 93% by mass through 97% by mass.

<Carrier>

The carrier is not particularly limited and may be appropriately selected depending on the intended purpose. The carrier preferably contains a core material and a resin layer coating the core material.

—Core Material—

The core material is not particularly limited as long as the core material is particles having magnetism. Suitable examples of the core material include, but are not limited to, ferrite, magnetite, iron, and nickel. Considering sensitiveness to environmental friendliness that has rapidly been growing in recent years, for ferrite, it is suitable to use, rather than conventional copper-zinc-based ferrite, manganese ferrite, manganese-magnesium ferrite, manganese-strontium ferrite, manganese-magnesium-strontium ferrite, and lithium-based ferrite.

(Toner Stored Unit)

A toner stored unit of the present disclosure includes a toner and a unit configured to store the toner, the toner being stored in the unit. Here, examples of the toner stored unit include, but are not limited to, toner stored containers, developing devices, and process cartridges.

The toner stored container is a container that stores the toner.

The developing device includes a unit that stores the toner and is configured to perform development.

The process cartridge includes an electrostatic latent image bearer (which may be referred to simply as an image bearer) and a developing unit which are integrally supported. The process cartridge stores the toner and is detachably mountable to an image forming apparatus. The process cartridge may further include at least one selected from the group consisting of a charging unit, an exposing unit, and a cleaning unit.

When the toner stored unit of the present disclosure is mounted in an image forming apparatus to perform image formation, it is possible to form an image of high definition and high quality while maintaining glittering texture of the image.

Image formation using the toner of the present disclosure will be described below.

FIG. 1 is an entire configurational view of an image forming apparatus embodying the present disclosure.

The image forming apparatus 1 illustrated in FIG. 1 is a color image forming apparatus configured to form a color image by a tandem-type image forming unit (hereinafter referred to as an image forming unit), including an image reading unit 10, an image forming unit 11, a paper sheet feeding unit 12, a transfer unit 13, a fixing unit 14, a paper ejection unit 15, and a control unit 16. The control unit 16 is configured to control the deposition amount of special toner based on information on the deposition amount of color toners according to a program stored therein.

(Image Reading Unit 10)

The image reading unit 10 is a part configured to read an image of a document and to generate image information. The image reading unit 10 includes a contact glass 101 and a reading sensor 102. In the image reading unit 10, light is emitted to the document, the reflected light is received by a sensor such as a charge coupled device (CCD) or a contact-type image sensor (CIS), and electrical color separation signals of RGB colors that are three primary colors of light are read.

(Image Forming Unit 11)

The image forming unit 11 includes five image forming units 110S, 110Y, 110M, 110C, and 110K configured to form and output toner images of a special color (S), such as colorless and transparent (clear) and white, and four colors of yellow (Y), magenta (M), cyan (C), and black (K), respectively.

The five image forming units 110S, 110Y, 110M, 110C, and 110K have the same configuration except that they use mutually different color toners of S, Y, M, C, and K as image forming materials. They are replaced at the end of their service life. Each of the image forming units 110S, 110Y, 110M, 110C, 110K is detachably mounted in an apparatus main body 2, constituting a so-called process cartridge. The common configuration will be described by taking, as an example, the image forming unit 110K configured to form a K toner image.

The image forming unit 110K includes, for example, a charging device 111K, a photoconductor 112K as an image bearer for a K color toner configured to bear an image of the K color toner on a surface thereof, a developing device 114K, a charge-eliminating device 115K, and a photoconductor cleaning device 116K. Because these devices are held on the common holding body and are integratedly detachably mounted in the apparatus main body 2, they can be replaced at the same time.

The photoconductor 112K is a drum-shaped photoconductor with an outer diameter of 60 mm including an organic photoconductive layer formed on the surface of a substrate. The photoconductor 112K is driven by a driving unit to rotate counterclockwise. When the charging device 111K applies charging bias to a charging wire that is a charging electrode of a charger (a charging unit), discharge occurs between the charging wire and the circumferential surface of the photoconductor 112K to uniformly charge the surface of the photoconductor 112K. In the present embodiment, the surface of the photoconductor 112K is charged to have a negative polarity that is the same as the charging polarity of the toner. The charging bias employed is a charging bias generated by superimposing AC voltage on DC voltage.

Instead of the charger, a charging roller disposed in contact with or in proximity to the photoconductor 112K may be used.

The uniformly charged surface of the photoconductor 112K is optically scanned with laser light emitted from an exposure device 113, which will be described below, to form an electrostatic latent image for K. In the entire region of the uniformly charged surface of the photoconductor 112K, the electrical potential is attenuated in the laser-irradiated portions to form an electrostatic latent image in which the electrical potential in the laser-irradiated portions is smaller than the electrical potential in the other portions (i.e., the background portion). The developing device 114K using the K toner, which will be described below, develops the electrostatic latent image for K to form a K toner image. The K toner image is primarily transferred onto an intermediate transfer belt 131, which will be described below.

The developing device 114K includes a container that stores a two-component developer including the K toner and a carrier, and is configured to bear the developer on the surface of a developing sleeve by the magnetic force of a magnet roller in the developing sleeve provided in the container. The developing sleeve receives a developing bias having the same polarity as the polarity of the toner and having such a charging electrical potential that is higher than the charging electrical potential of the electrostatic latent image on the photoconductor 112K but is lower than the charging electrical potential of the photoconductor 112K. Between the developing sleeve and the electrostatic latent image on the photoconductor 112K, a developing potential occurs from the developing sleeve toward the electrostatic latent image. Between the developing sleeve and the background portion of the photoconductor 112K, a non-developing potential occurs that transfers the toner on the developing sleeve toward the surface of the sleeve. By the action of the developing potential and the non-developing potential, the K toner on the developing sleeve is allowed to selectively adhere to the electrostatic latent image on the photoconductor 112K to form a toner image of the K color on the photoconductor 112K.

The charge-eliminating device 115K is configured to eliminate the charges from the surface of the photoconductor 112K after the toner image has been primarily transferred onto the intermediate transfer belt 131. The photoconductor cleaning device 116K is configured to remove, for example, the residual toner remaining after transfer on the surface of the photoconductor 112K that has undergone charge-elimination by the charge-eliminating device 115K.

In FIG. 1, the image forming unit 110S includes, for example, a charging device 111S, a photoconductor 112S as an image bearer for a special color toner configured to bear an image of a special color toner on a surface thereof, a developing device 114S, a charge-eliminating device 115S, and a photoconductor cleaning device 116S. Each of the other image forming units 110C, 110M, and 110Y has the same configuration. That is, the image forming unit 110C, the image forming unit 110M, the image forming unit 110Y, and the image forming unit 110S form a S toner image, a Y toner image, a M toner image, and a C toner image on the photoconductor 112S, the photoconductor 112Y, the photoconductor 112M, and the photoconductor 112C, respectively, in the same manner as in the image forming unit 10K.

The exposure device 113 as a latent image writing unit or an exposing unit is disposed above the image forming units 110S, 110Y, 110M, 110C, and 110K. The exposure device 113 optically scans the photoconductors 112S, 112Y, 112M, 112C, and 112K with laser light emitted from a laser diode based on image information transmitted from the image reading unit 10 or an external device such as a personal computer.

The exposure device 113 is configured to irradiate the photoconductors 112S, 112Y, 112M, 112C, and 112K with laser light emitted from a light source via a plurality of optical lenses and mirrors while a polygon mirror driven to rotate by a polygon motor polarizes the light in the main scanning direction. Instead of the laser light, LED light emitted from a plurality of LEDs may be employed for optical writing and irradiation.

(Paper Sheet Feeding Unit 12)

The paper sheet feeding unit 12 is configured to feed a paper sheet, which is one example of paper, to the transfer unit 13, including a paper sheet housing 121, a paper sheet pickup roller 122, a paper sheet feeding belt 123, and a registration roller 124. The paper sheet pickup roller 122 is rotatably provided so as to transfer paper sheets stored in the paper sheet housing 121 toward the paper sheet feeding belt 123. The paper sheet pickup roller 122 as provided above is configured to pick up a paper sheet in the uppermost part from the stored paper sheets to place the paper sheet to the paper sheet feeding belt 123. The paper sheet feeding belt 123 is configured to convey the paper sheet picked up by the paper sheet pickup roller 122 to the transfer unit 13. The registration roller 124 is configured to feed the paper sheet at the timing when a portion of the intermediate transfer belt 131 on which the toner image is formed reaches a secondary transfer nip 139 as a transfer nip of the transfer unit 13.

(Transfer Unit 13)

The transfer unit 13 is disposed under the image forming units 110S, 110Y, 110M, 110C, and 110K. The transfer unit 13 includes a driving roller 132, a driven roller 133, an intermediate transfer belt 131, primary transfer rollers 134S, 134Y, 134M, 134C, and 134K, a secondary transfer roller 135, a secondary transfer counter roller 136, a toner deposition amount sensor 137, and a belt cleaning device 138.

The intermediate transfer belt 131 functions as an endless intermediate transfer member and is supported in a stretched manner by, for example, the driving roller 132, the driven roller 133, the secondary transfer counter roller 136, and the primary transfer rollers 134S, 134Y, 134M, 134C, and 134K arranged inside the loop of the intermediate transfer belt 131. Here, "being arranged" means "being disposed and provided" or "being provided at determined positions", and "being supported in a stretched manner" means "being supported under application of tension".

The driving roller 132 driven by the driving unit to rotate clockwise in FIG. 1 allows the intermediate transfer belt 131 to move and run endlessly in the same direction. The intermediate transfer belt 131 moves in the state of being in contact with the photoconductors 112S, 112Y, 112M, 112C, and 112K.

The thickness of the intermediate transfer belt 131 is from 20 through 200 [μm], preferably about 60 [μm]. A carbon dispersed polyimide resin having a volume resistivity of from $1\times10^{6}$ through $1\times10^{12}$ [Ω·cm], preferably about $1\times10^{9}$ [Ω·cm] (as measured at an applied voltage of 100 V using HIRESTA-UP MCP HT45 available from Mitsubishi Chemical Corporation) is desirable.

The toner deposition amount sensor 137 is disposed near the intermediate transfer belt 131 supported by the driving roller 132. The toner deposition amount sensor 137 functions as a toner amount detector configured to detect the amount of the toner image transferred onto the intermediate transfer belt 131. The toner deposition amount sensor 137 includes a light reflection-type photosensor. The toner deposition amount sensor 137 is configured to detect the quantity of light reflected from an image of the toner (including the special color toner) attached and formed on the intermediate transfer belt 131 to measure the toner deposition amount. Considering the functions, the toner deposition amount sensor 137 may be, for example, a toner density sensor conventionally used as a toner density detector configured to detect and measure the toner density. In this case, it is possible to avoid arranging a new toner amount detector, leading to cost reduction by virtue of the decreased number of parts. Instead of the position facing the intermediate transfer belt 131, the toner deposition amount sensor 137 may be disposed at such a position as to detect the toner image on the photoconductor 112.

Via the intermediate transfer belt 131, the primary transfer rollers 134S, 134Y, 134M, 134C, and 134K are disposed so as to face the photoconductors 112S, 112Y, 112M, 112C, and 112K, respectively. The primary transfer rollers 134S, 134Y, 134M, 134C, and 134K follow and rotate to move the intermediate transfer belt 131. With this configuration, a primary transfer nip is formed, at which the outside surface of the intermediate transfer belt 131 abuts on the photoconductors 112S, 112Y, 112M, 112C, and 112K (which means that the outside surface of the intermediate transfer belt 131 comes into contact with the photoconductors 112S, 112Y, 112M, 112C, and 112K). A primary transfer bias is applied to each of the primary transfer rollers 134S, 134Y, 134M, 134C, and 134K by a primary transfer bias power source. This forms primary transfer biases between S, Y, M, C, K toner images on the photoconductors 112S, 112Y, 112M, 112C, and 112K and the primary transfer rollers 134S, 134Y, 134M, 134C, and 134K. The toner images of respective colors are sequentially transferred onto the intermediate transfer belt 131.

The S toner image formed on the surface of the photoconductor 112S for S enters the primary transfer nip for S in response to the rotation of the photoconductor 112S. By the action of the transfer bias or the nip pressure, the S toner image is primarily transferred on the intermediate transfer belt 131 from the photoconductor 112S. The intermediate transfer belt 131 onto which the S toner image has been primarily transferred in this manner sequentially passes through the primary transfer nips for Y, M, C, and K. The Y, M, C, and K toner images on the photoconductors 112Y, 112M, 112C, and 112K are sequentially superimposed on the S toner image for primary transfer. Through the primary transfer by superimposing the toner images, a superimposed toner image including color toner images and a special toner (e.g., a clear toner) image is formed on the intermediate transfer belt 131. In other words, the toner images on the surfaces of the image bearers for color toners and the image bearer for the special toner are superimposed and transferred onto the intermediate transfer belt 131.

Each of the primary transfer rollers 134S, 134Y, 134M, 134C, and 134K is formed of an elastic roller that includes a metallic cored bar and an electrically conductive sponge layer fixed on the surface of the cored bar. Each primary transfer roller has an outer diameter of 16 [mm] and a cored bar diameter of 10 [mm]. The resistance value R of the sponge layer is calculated from the electric current I flowing when voltage of the 1,000 [V] is applied to the cored bars of the primary transfer rollers 134S, 134Y, 134M, 134C, and 134K with the grounded metallic roller having an outer diameter of 30 [mm] pressed against the sponge layer at a force of 10 [N]. Specifically, the resistance value R of the sponge layer, which is calculated based on the Ohm's low (R=V/I) from the electric current I flowing when voltage of the 1,000 [V] is applied to the cored bars, is about $3\times10^7$ [Ω]. The primary transfer bias output from the primary transfer bias power source under the constant current control is applied to the primary transfer rollers 134S, 134Y, 134M, 134C, and 134K. Instead of the primary transfer rollers 134S, 134Y, 134M, 134C, and 134K, for example, a transfer charger or a transfer brush may be used.

The secondary transfer roller 135 is driven to rotate by the driving unit with the intermediate transfer belt 131 and the paper sheet sandwiched between the secondary transfer roller 135 and the secondary transfer counter roller 136. The secondary transfer roller 135 contacts with the outside surface of the intermediate transfer belt 131 to form a secondary transfer nip 139 as a transfer nip. The secondary transfer roller 135 also functions as a nip forming member and a transfer member that transfer the toner image on the intermediate transfer belt to a recording medium sandwiched at the secondary transfer nip. The secondary transfer counter roller 136 functions as a nip forming member and a counter member. The secondary transfer roller 135 is grounded, while the secondary transfer counter roller 136 receives a secondary transfer bias applied by a secondary transfer bias power source 130.

The secondary transfer bias power source 130 includes a DC power source and an AC power source. The secondary transfer bias power source 130 can output the secondary transfer bias obtained by superimposing AC voltage on DC voltage. An output terminal of the secondary transfer bias power source 130 is coupled to a cored bar of the secondary transfer counter roller 136. An electrical potential of the cored bar of the secondary transfer counter roller 136 is substantially the same as the output voltage from the secondary transfer bias power source 130.

Application of the secondary transfer bias to the secondary transfer counter roller 136 forms, between the secondary transfer counter roller 136 and the secondary transfer roller 135, the secondary transfer bias that electrostatically transfers the toner having a negative polarity from a side of the secondary transfer counter roller 136 toward a side of the secondary transfer roller 135. This makes it possible to transfer the toner having a negative polarity on the intermediate transfer belt 131 from the side of the secondary transfer counter roller 136 toward the side of the secondary transfer roller 135.

The secondary transfer bias power source 130 uses a DC component having a negative polarity that is the same as the polarity of the toner, so that the electrical potential of the superimposed bias averaged over time has a negative polarity that is the same as the polarity of the toner. Instead of grounding the secondary transfer roller 135 while applying the superimposed bias to the secondary transfer counter roller 136, the cored bar of the secondary transfer counter roller 136 may be grounded while applying the superimposed bias to the secondary transfer roller 135. In this case, the polarities of the DC voltage and the DC component are made different.

When using a paper sheet with a high degree of surface irregularities such as an embossed paper sheet, the superimposed bias is applied to reciprocally move the toner but relatively move the toner from the side of the intermediate transfer belt 131 toward the side of the paper sheet to transfer the toner onto the paper sheet. This makes it possible to improve transferability to concave portions of the paper, resulting in an increase in a transfer ratio and improvement in abnormal images such as voids. Meanwhile, when using a paper sheet with a low degree of surface irregularities such as a common transfer paper sheet, a contrast pattern reflecting the surface irregularities does not appear. Therefore, application of the secondary transfer bias generated only by the DC component makes it possible to obtain sufficient transferability.

The secondary transfer counter roller 136 includes a cored bar formed of, for example, stainless steel or aluminum, and a resistive layer laminated on the cored bar. The secondary transfer counter roller 136 has the following properties. Specifically, its outer diameter is about 24 [mm]. The diameter of the cored bar is about 16 [mm]. The resistive layer is formed of, for example, a material obtained by dispersing carbon or electrically conductive particles of, for example, metal complexes in polycarbonate, fluorine-based rubber, silicon-based rubber, rubber such as acrylonitrile-butadiene rubber (NBR) and ethylene-propylene-diene rubber (EPDM), rubber of NBR/epichlorohydrin rubber (ECO) copolymer, or semi conductive rubber formed of polyurethane. Its volume resistivity is from $10^6$ [Ω] through $10^{12}$ [Ω], desirably from $10^7$ [Ω] through $10^9$ [Ω]. A foamed rubber having a rubber hardness (ASKER-C) of from 20 degrees through 50 degrees, or a rubber having a rubber hardness of from 30 degrees through 60 degrees may be used. However, since the secondary transfer counter roller 136 contacts with the secondary transfer roller 135 via the intermediate transfer belt 131, it is desirably formed of a sponge that does not generate non-contact portions even under a small contact pressure. On the intermediate transfer belt 131 after the secondary transfer that has passed through the secondary transfer nip, there remains the toner that has not been transferred onto the paper sheet. This toner is removed and cleaned from the surface of the intermediate transfer belt 131 by a belt cleaning device 138 including a cleaning blade, which is in contact with the surface of the intermediate transfer belt 131.

(Fixing Unit 14)

The fixing unit 14 is of a belt-fixing type, including an endless fixing belt 141 and a press roller 142 pressed against the fixing belt 141. The fixing belt 141 is supported around a fixing roller 143 and a heating roller 144, and at least one of the rollers is provided with a heat source/heating unit (e.g., heater, lamp, or electromagnetic induction-type heating device). The fixing belt 141 forms a fixing nip between the fixing belt 141 and the press roller 142 with the fixing belt 141 sandwiched and pressed between the fixing roller 143 and the press roller 142.

The paper sheet fed to the fixing unit 14 is sandwiched at the fixing nip with the surface having an unfixed toner image being adhering to the fixing belt 141. Because application of heat or pressure softens the toner in the toner image, the toner image is fixed, and then the paper sheet is ejected outside the apparatus. In the case where an image is formed on the other surface of the paper sheet opposite to the surface onto which the toner image has been transferred, the paper sheet is conveyed to a paper reversing mechanism after fixing of the toner image, and the paper sheet is reversed by the paper sheet reversing mechanism. The toner image is formed also on the opposite surface in the same manner as in the above-described image forming step.

The paper sheet on which the toner has been fixed in the fixing unit 14 is ejected outside the apparatus from the image forming apparatus main body 2 via a paper ejection roller constituting the paper ejection unit 15, and is housed in a paper sheet housing part 151 such as a paper sheet ejection tray.

EXAMPLES

Hereinafter, the present disclosure will be described by way of Examples. However, the present disclosure should not be construed as being limited to the Examples. In the Examples, "part(s)" and "%" mean "part(s) by mass" and "% by mass", respectively, unless otherwise specified.

Production Example 1

—Polyester Resin (A) (Prepolymer)—

<Production of Reactive Precursor (a1) of Polyester Resin (A)>

A reaction vessel equipped with a condenser tube, a stirrer, and a nitrogen-introducing tube was charged with 3-methyl-1,5-pentanediol as a diol component, terephthalic acid/adipic acid (molar ratio: 55/45) as a dicarboxylic acid component, and trimellitic anhydride in an amount of 0.5 mol % relative to the total amount of the monomers so that the molar ratio (OH/COOH) between the hydroxyl group and the carboxylic acid would be 1.5. Tetrabutyl orthotitanate as a condensation catalyst was added to the mixture in an amount of 1,000 ppm relative to the total amount of the monomers. The temperature of the mixture was increased to 200° C. over 2 hours under a nitrogen gas stream, and was further increased to 230° C. over 2 hours. The mixture was allowed to react for 3 hours with the water generated being removed. The reaction mixture was allowed to react for 5 hours under reduced pressure of from 5 mmHg through 15 mmHg to obtain [Intermediate polyester 1] having a weight average molecular weight of 10,000.

A reaction vessel equipped with a condenser tube, a stirrer, and a nitrogen-introducing tube was charged with the [Intermediate polyester 1] and isophorone diisocyanate (IPDI) in such amounts that the molar ratio (NCO/OH) between the isocyanate group of the IPDI and the hydroxyl group of the [Intermediate polyester 1] would be 2.0. Ethyl acetate was added to the mixture to dissolve the materials to obtain a 50% ethyl acetate solution. The solution was increased in temperature to 80° C. and allowed to react for 5 hours under a nitrogen gas stream, to obtain an ethyl acetate solution of [Reactive precursor (a1)] that was a reactive precursor of polyester resin (A).

In the Example described below, the [Reactive precursor (a1)] reacts with an amine in the production of a toner to form an amine-extended product. It is difficult to extract the amine-extended product of the [Reactive precursor (a1)] from the toner to measure physical properties of the amine-extended product. Therefore, under the same conditions as the conditions under which the amine-extended product of the [Reactive precursor (a1)] is produced in the production of the toner, the amine-extended product of the [Reactive precursor (a1)] was produced in the following manner. The obtained amine-extended product of the [Reactive precursor (a1)] was measured for the glass transition temperature from a DSC curve at the first heating in DSC.

(Production of Amine-Extended Product of [Reactive Precursor (a1)])

First, ethyl acetate was added to the [Reactive precursor (a1)] to be a 20% ethyl acetate solution. A 20% ethyl acetate solution of isophoronediamine (IPDA) was added dropwise to the solution under stirring in such an amount that the molar ratio ($NH_2$/NCO) between the isocyanate group of the [Reactive precursor (a1)] and the amino group of the IPDA would be 1.1, followed by sufficiently stirring. The ethyl acetate solution of the amine-extended product was cast on a TEFLON (registered trademark) dish. The dish was dried for 10 hours in an environment of 80° C. and was further dried under reduced pressure in an environment of 120° C.

and 10 kPa or less. The solvent was sufficiently removed to obtain the amine-extended product of the [Reactive precursor (a1)].

The glass transition temperature of the amine-extended product of the [Reactive precursor (a1)], which was determined from a DSC curve at the first heating in DSC, was −35° C.

<Production of Reactive Precursor (a2) of Polyester Resin (A)>

A reaction vessel equipped with a condenser tube, a stirrer, and a nitrogen-introducing tube was charged with 3-methyl-1,5-pentanediol as a diol component, terephthalic acid/adipic acid (molar ratio: 55/45) as a dicarboxylic acid component, trimethylolpropane in an amount of 1.0 mol % relative to the total amount of the monomers, and trimellitic anhydride in an amount of 0.5 mol % relative to the total amount of the monomers so that the molar ratio (OH/COOH) between the hydroxyl group and the carboxylic acid would be 1.7. Tetrabutyl orthotitanate as a condensation catalyst was added to the mixture in an amount of 1,000 ppm relative to the total amount of the monomers. The temperature of the mixture was increased to 200° C. over 2 hours under a nitrogen gas stream, and was further increased to 230° C. over 2 hours. The mixture was allowed to react for 3 hours with the water generated being removed. The reaction mixture was allowed to react for 5 hours under reduced pressure of from 5 mmHg through 15 mmHg to obtain [Intermediate polyester 2] having a weight average molecular weight of 18,000.

A reaction vessel equipped with a condenser tube, a stirrer, and a nitrogen-introducing tube was charged with the [Intermediate polyester 2] and isophorone diisocyanate (IPDI) in such amounts that the molar ratio (NCO/OH) between the isocyanate group of the IPDI and the hydroxyl group of the [Intermediate polyester 1] would be 2.0. Ethyl acetate was added to the mixture to dissolve the materials to obtain a 50% ethyl acetate solution. The solution was increased in temperature to 80° C. and allowed to react for 5 hours under a nitrogen gas stream, to obtain an ethyl acetate solution of [Reactive precursor (a2)] that was a reactive precursor of polyester resin (A).

An amine-extended product of the [Reactive precursor (a2)] was obtained using the [Reactive precursor (a2)] in the same manner as in the production of the amine-extended product of the [Reactive precursor (a1)]. The amine-extended product of the [Reactive precursor (a2)] was measured for the glass transition temperature.

The glass transition temperature of the amine-extended product of the [Reactive precursor (a2)], which was determined from a DSC curve at the first heating in DSC, was 8° C.

<Production of Reactive Precursor (a3) of Polyester Resin (A)>

A reaction vessel equipped with a condenser tube, a stirrer, and a nitrogen-introducing tube was charged with 3-methyl-1,5-pentanediol as a diol component, isophthalic acid/adipic acid (molar ratio: 30/70) as a dicarboxylic acid component, and trimellitic anhydride in an amount of 0.5 mol % relative to the total amount of the monomers so that the molar ratio (OH/COOH) between the hydroxyl group and the carboxylic acid would be 1.5. Tetrabutyl orthotitanate as a condensation catalyst was added to the mixture in an amount of 1,000 ppm relative to the total amount of the monomers. The temperature of the mixture was increased to 200° C. over 2 hours under a nitrogen gas stream, and was further increased to 230° C. over 2 hours. The mixture was allowed to react for 3 hours with the water generated being removed. The reaction mixture was allowed to react for 5 hours under reduced pressure of from 5 mmHg through 15 mmHg to obtain [Intermediate polyester 3] having a weight average molecular weight of 5,500.

A reaction vessel equipped with a condenser tube, a stirrer, and a nitrogen-introducing tube was charged with the [Intermediate polyester 3] and isophorone diisocyanate (IPDI) in such amounts that the molar ratio (NCO/OH) between the isocyanate group of the IPDI and the hydroxyl group of the [Intermediate polyester 3] would be 2.0. Ethyl acetate was added to the mixture to dissolve the materials to obtain a 50% ethyl acetate solution. The solution was increased in temperature to 80° C. and allowed to react for 5 hours under a nitrogen gas stream, to obtain an ethyl acetate solution of [Reactive precursor (a3)] that was a reactive precursor of polyester resin (A).

An amine-extended product of the [Reactive precursor (a3)] was obtained using the [Reactive precursor (a3)] in the same manner as in the production of the amine-extended product of the [Reactive precursor (a1)]. The amine-extended product of the [Reactive precursor (a3)] was measured for the glass transition temperature.

The glass transition temperature of the amine-extended product of the [Reactive precursor (a3)], which was determined from a DSC curve at the first heating in DSC, was −51° C.

<Production of Reactive Precursor (a4) of Polyester Resin (A)>

A reaction vessel equipped with a condenser tube, a stirrer, and a nitrogen-introducing tube was charged with 3-methyl-1,5-pentanediol/ethylene oxide 2 mol adduct of bisphenol A (molar ratio: 45/55) as a diol component, terephthalic acid/adipic acid (molar ratio: 55/45) as a dicarboxylic acid component, and trimellitic anhydride in an amount of 0.5 mol % relative to the total amount of the monomers so that the molar ratio (OH/COOH) between the hydroxyl group and the carboxylic acid would be 1.5. Tetrabutyl orthotitanate as a condensation catalyst was added to the mixture in an amount of 1,000 ppm relative to the total amount of the monomers. Under a nitrogen gas stream, the temperature of the mixture was increased to 200° C. over 2 hours, and was further increased to 230° C. over 2 hours. The mixture was allowed to react for 3 hours with the water generated being removed. The reaction mixture was allowed to react for 5 hours under reduced pressure of from 5 mmHg through 15 mmHg to obtain [Intermediate polyester 4] having a weight average molecular weight of 12,000.

A reaction vessel equipped with a condenser tube, a stirrer, and a nitrogen-introducing tube was charged with the [Intermediate polyester 4] and isophorone diisocyanate (IPDI) in such amounts that the molar ratio (NCO/OH) between the isocyanate group of the IPDI and the hydroxyl group of the [Intermediate polyester 4] would be 2.0. Ethyl acetate was added to the mixture to dissolve the materials to obtain a 50% ethyl acetate solution. The solution was increased in temperature to 80° C. and allowed to react for 5 hours under a nitrogen gas stream, to obtain an ethyl acetate solution of the [Reactive precursor (a4)] that was a reactive precursor of polyester resin (A).

An amine-extended product of the [Reactive precursor (a4)] was obtained using the [Reactive precursor (a4)] in the same manner as in the production of the amine-extended product of the [Reactive precursor (a1)]. The amine-extended product of the [Reactive precursor (a4)] was measured for the glass transition temperature.

The glass transition temperature of the amine-extended product of the [Reactive precursor (a4)], which was determined from a DSC curve at the first heating in DSC, was −45° C.

<Production of Reactive Precursor (a5) of Polyester Resin (A)>

A reaction vessel equipped with a condenser tube, a stirrer, and a nitrogen-introducing tube was charged with 1,6-hexanediol as a diol component, terephthalic acid/adipic acid (molar ratio: 55/45) as a dicarboxylic acid component, and trimellitic anhydride in an amount of 0.5 mol % relative to the total amount of the monomers so that the molar ratio (OH/COOH) between the hydroxyl group and the carboxylic acid would be 1.5. Tetrabutyl orthotitanate as a condensation catalyst was added to the mixture in an amount of 1,000 ppm relative to the total amount of the monomers. Under a nitrogen gas stream, the temperature of the mixture was increased to 200° C. over 2 hours, and was further increased to 230° C. over 2 hours. The mixture was allowed to react for 3 hours with the water generated being removed. The reaction mixture was allowed to react for 5 hours under reduced pressure of from 5 mmHg through 15 mmHg to obtain [Intermediate polyester 5] having a weight average molecular weight of 10,000.

A reaction vessel equipped with a condenser tube, a stirrer, and a nitrogen-introducing tube was charged with the [Intermediate polyester 5] and isophorone diisocyanate (IPDI) in such amounts that the molar ratio (NCO/OH) between the isocyanate group of the IPDI and the hydroxyl group of the [Intermediate polyester 5] would be 2.0. Ethyl acetate was added to the mixture to dissolve the materials to obtain a 50% ethyl acetate solution. The solution was increased in temperature to 80° C. and allowed to react for 5 hours under a nitrogen gas stream, to obtain an ethyl acetate solution of [Reactive precursor (a5)] that was a reactive precursor of polyester resin (A).

An amine-extended product of the [Reactive precursor (a5)] was obtained using the [Reactive precursor (a5)] in the same manner as in the production of the amine-extended product of the [Reactive precursor (a1)]. The amine-extended product of the [Reactive precursor (a5)] was measured for the glass transition temperature.

The glass transition temperature of the amine-extended product of the [Reactive precursor (a5)], which was determined from a DSC curve at the first heating in DSC, was −35° C.

<Production of Reactive Precursor (a6) of Polyester Resin (A)>

A reaction vessel equipped with a condenser tube, a stirrer, and a nitrogen-introducing tube was charged with 3-methyl-1,5-pentanediol as a diol component, sebacic acid as a dicarboxylic acid component, and trimellitic anhydride in an amount of 0.5 mol % relative to the total amount of the monomers in such amounts that the molar ratio (OH/COOH) between the hydroxyl group and the carboxylic acid would be 1.6. Tetrabutyl orthotitanate as a condensation catalyst was added to the mixture in an amount of 1,000 ppm relative to the total amount of the monomers. Under a nitrogen gas stream, the temperature of the mixture was increased to 200° C. over 2 hours, and was further increased to 230° C. over 2 hours. The mixture was allowed to react for 3 hours with the water generated being removed. The reaction mixture was allowed to react for 5 hours under reduced pressure of from 5 mmHg through 15 mmHg to obtain [Intermediate polyester 6] having a weight average molecular weight of 7,500.

A reaction vessel equipped with a condenser tube, a stirrer, and a nitrogen-introducing tube was charged with the [Intermediate polyester 6] and isophorone diisocyanate (IPDI) in such amounts that the molar ratio (NCO/OH) between the isocyanate group of the IPDI and the hydroxyl group of the [Intermediate polyester 6] would be 2.0. Ethyl acetate was added to the mixture to dissolve the materials to obtain a 50% ethyl acetate solution. The solution was increased in temperature to 80° C. and allowed to react for 5 hours under a nitrogen gas stream, to obtain an ethyl acetate solution of [Reactive precursor (a6)] that was a reactive precursor of polyester resin (A).

An amine-extended product of the [Reactive precursor (a6)] was obtained using the [Reactive precursor (a6)] in the same manner as in the production of the amine-extended product of the [Reactive precursor (a1)]. The amine-extended product of the [Reactive precursor (a6)] was measured for the glass transition temperature.

The glass transition temperature of the amine-extended product of the [Reactive precursor (a6)], which was determined from a DSC curve at the first heating in DSC, was −70° C.

<Production of Reactive Precursor (a7) of Polyester Resin (A)>

A reaction vessel equipped with a condenser tube, a stirrer, and a nitrogen-introducing tube was charged with ethylene oxide 2 mol adduct of bisphenol A/propylene oxide 3 mol adduct of bisphenol A (molar ratio: 90/10) as a diol component, terephthalic acid as a dicarboxylic acid component, and trimellitic anhydride in an amount of 0.5 mol % relative to the total amount of the monomers so that the molar ratio (OH/COOH) between the hydroxyl group and the carboxylic acid would be 1.5. Dibutyltin oxide as a condensation catalyst was added to the mixture in an amount of 1,000 ppm relative to the total amount of the monomers. Under a nitrogen gas stream, the temperature of the mixture was increased to 200° C. over 2 hours, and was further increased to 230° C. over 2 hours. The mixture was allowed to react for 3 hours with the water generated being removed. The reaction mixture was allowed to react for 5 hours under reduced pressure of from 10 mmHg through 15 mmHg to obtain [Intermediate polyester 7] having a weight average molecular weight (Mw) of 9,600.

A reaction vessel equipped with a condenser tube, a stirrer, and a nitrogen-introducing tube was charged with the [Intermediate polyester 7] and isophorone diisocyanate (IPDI) in such amounts that the molar ratio (NCO/OH) between the isocyanate group of IPDI and the hydroxyl group of the [intermediate polyester 7] would be 2.0. Ethyl acetate was added to the mixture to dissolve the materials to obtain a 50% ethyl acetate solution. The solution was increased in temperature to 80° C. and allowed to react for 5 hours under a nitrogen gas stream, to obtain an ethyl acetate solution of [Reactive precursor (a7)] that was a reactive precursor of polyester resin (A).

An amine-extended product of the [Reactive precursor (a7)] was obtained using the [Reactive precursor (a7)] in the same manner as in the production of the amine-extended product of the [Reactive precursor (a1)]. The amine-extended product of the [Reactive precursor (a7)] was measured for the glass transition temperature.

The glass transition temperature of the amine-extended product of the [Reactive precursor (a7)], which was determined from a DSC curve at the first heating in DSC, was 55° C.

Production Example 2

—Non-Crystalline Polyester Resin (B)—

<Synthesis of Non-Crystalline Polyester Resin (B1)>

A reaction vessel equipped with a condenser tube, a stirrer, and a nitrogen-introducing tube was charged with ethylene oxide 2 mol adduct of bisphenol A/propylene oxide 2 mol adduct of bisphenol A (molar ratio: 50/50) as a diol component, and terephthalic acid/adipic acid (molar ratio: 80/20) as a dicarboxylic acid component so that the molar ratio (OH/COOH) between the hydroxyl group and the carboxylic acid would be 1.2. Tetrabutyl orthotitanate as a condensation catalyst was added to the mixture in an amount of 1,000 ppm relative to the total amount of the monomers. Under a nitrogen gas stream, the mixture was increased in temperature to 230° C. over 2 hours and allowed to react for 5 hours with the water generated being removed. The reaction mixture was allowed to react for 5 hours under reduced pressure of from 5 mmHg through 15 mmHg to obtain [Non-crystalline polyester resin (B1)] having a weight average molecular weight of 4,000.

<Synthesis of Non-Crystalline Polyester Resin (B2)>

A reaction vessel equipped with a condenser tube, a stirrer, and a nitrogen-introducing tube was charged with ethylene oxide 2 mol adduct of bisphenol A/propylene oxide 3 mol adduct of bisphenol A (molar ratio: 30/70) as a diol component, terephthalic acid/adipic acid (molar ratio: 80/20) as a dicarboxylic acid component, and trimethylolpropane in an amount of 3.5 mol % relative to the total amount of the monomers so that the molar ratio (OH/COOH) between the hydroxyl group and the carboxylic acid would be 1.2. Tetrabutyl orthotitanate as a condensation catalyst was added to the mixture in an amount of 1,000 ppm relative to the total amount of the monomers. Under a nitrogen gas stream, the mixture was increased in temperature to 230° C. over 2 hours and allowed to react for 5 hours with the water generated being removed. The reaction mixture was allowed to react for 5 hours under reduced pressure of from 5 mmHg through 15 mmHg, followed by cooling to 180° C. Trimellitic anhydride in an amount of 1.0 mol % relative to the total amount of the monomers and tetrabutyl orthotitanate in an amount of 200 ppm relative to the total amount of the monomers were added to the reaction mixture. The reaction mixture was allowed to react at 180° C. for 1 hour under normal pressure and was further allowed to react for 3 hours under reduced pressure of from 5 mmHg through 20 mmHg, to obtain [Non-crystalline polyester resin (B2)] having a weight average molecular weight of 9,000.

<Synthesis of Non-Crystalline Polyester Resin (B3)>

A reaction vessel equipped with a condenser tube, a stirrer, and a nitrogen-introducing tube was charged with ethylene oxide 2 mol adduct of bisphenol A/propylene oxide 3 mol adduct of bisphenol A (molar ratio: 10/90) as a diol component, terephthalic acid/adipic acid (molar ratio: 90/10) as a dicarboxylic acid component, and trimethylolpropane in an amount of 3.5 mol % relative to the total amount of the monomers so that the molar ratio (OH/COOH) between the hydroxyl group and the carboxylic acid would be 1.2. Tetrabutyl orthotitanate as a condensation catalyst was added to the mixture in an amount of 1,000 ppm relative to the total amount of the monomers. Under a nitrogen gas stream, the mixture was increased in temperature to 230° C. over 2 hours and allowed to react for 5 hours with the water generated being removed. The reaction mixture was allowed to react for 5 hours under reduced pressure of from 5 mmHg through 15 mmHg, followed by cooling to 180° C. Trimellitic anhydride in an amount of 1.0 mol % relative to the total amount of the monomers and tetrabutyl orthotitanate in an amount of 200 ppm relative to the total amount of the monomers were added to the reaction mixture. The reaction mixture was allowed to react at 180° C. for 1 hour under normal pressure and was further allowed to react for 3 hours under reduced pressure of from 5 mmHg through 20 mmHg, to obtain [Non-crystalline polyester resin (B3)] having a weight average molecular weight of 12,000.

Production Example 3

<Synthesis of Crystalline Polyester Resin (C)>

A reaction vessel equipped with a condenser tube, a stirrer, and a nitrogen-introducing tube was charged with 1,6-hexanediol as a diol component and sebacic acid as a dicarboxylic acid component so that the molar ratio (OH/COOH) between the hydroxyl group and the carboxylic acid would be 1.2.

Titanium tetraisopropoxide in an amount of 500 ppm relative to the total amount of the monomers was added to the mixture. The mixture was increased in temperature to 180° C. for 2 hours and allowed to react for 8 hours with the water generated being removed. While gradually increased in temperature to 200° C., the reaction mixture was allowed to react for 3 hours with the water generated being removed under a nitrogen gas stream. The reaction mixture was allowed to further react under reduced pressure of from 5 mmHg through 20 mmHg to obtain [Crystalline polyester resin (C)] having a melting point of 67° C. and a weight average molecular weight of 20,000.

<Preparation of Crystalline Polyester Resin (C) Dispersion Liquid>

A reaction container equipped with a condenser tube, a thermometer, and a stirrer was charged with the [Crystalline polyester resin (C)] (10 parts) and ethyl acetate (90 parts). The temperature of the mixture was increased to 80° C. under stirring to sufficiently dissolve the [Crystalline polyester resin (C)]. The solution was cooled to 30° C., followed by wet pulverization using an Ultra visco mill of a bead mill (available from Aimex Co., Ltd.) under the conditions: a liquid feeding speed of 1 kg/h; a circumferential disk speed of 6 m/s; zirconia beads with a diameter of 0.5 mm loaded in an amount of 80% by volume; and 6 passes. Ethyl acetate was added to the resultant to prepare [Crystalline polyester resin (C) dispersion liquid] having a solid content concentration of 10%.

Production Example 4

<Synthesis of Wax Dispersant>

Xylene (480 parts) and paraffin wax HNP-9 (available from NIPPON SEIRO CO., LTD.) (100 parts) were charged into a reaction vessel equipped with a stirrer and a stirring rod, followed by heating until dissolution. The solution was purged with nitrogen and the temperature of the solution was increased to 170° C. A liquid mixture of styrene (740 parts), acrylonitrile (100 parts), butyl acrylate (60 parts), di-t-butyl peroxyhexahydroterephthalate (36 parts), and xylene (100 parts) was added dropwise to the mixture for 3 hours. The resultant mixture was maintained at 170° C. for 30 minutes. The solvent was removed from the mixture to obtain [Wax dispersant].

<Preparation of Wax Dispersion Liquid>

Ester wax LW-12 (available from Sanyo Chemical Industries, Ltd.) (100 parts), the [Wax dispersant] (40 parts), and ethyl acetate (300 parts) were charged into a container equipped with a stirring rod and a thermometer. The temperature of the mixture was increased to 80° C. under stirring for sufficient dissolution. The solution was cooled to 30° C., followed by dispersing using an Ultra visco mill of a bead mill (available from Aimex Co., Ltd.) under the conditions: a liquid feeding speed of 1 kg/h; a circumferential disk speed of 6 m/s; zirconia beads with a diameter of 0.5 mm loaded in an amount of 80% by volume; and 3 passes. Ethyl acetate was added to the resultant to prepare [Wax dispersion liquid]. The particle diameter of the [Wax dispersion liquid] measured using LA-920 (available from HORIBA, Ltd.) was 350 nm (the solid content concentration of the wax: 20%).

Production Example 5

<Preparation of Master Batch of Organically Modified Layered Inorganic Compound>

Water (200 parts), an organically modified layered inorganic compound (CLAYTONE, available from APA/SCP) (500 parts), and the non-crystalline polyester resin B1 (500 parts) were added to and mixed in a Henschel mixer (available from Mitsui Mining Co., Ltd.). The mixture was kneaded at 120° C. for 30 minutes using a twin-roll at 120° C. for 30 minutes. The resultant was subjected to cold rolling, followed by pulverizing using a pulverizer, to obtain [Master batch of organically modified layered inorganic compound].

Production Example 6

<Synthesis of Organic Particles Emulsion (Particles Dispersion Liquid)>

Water (683 parts), a sodium salt of a sulfuric acid ester of methacrylic acid ethylene oxide adduct, ELEMINOL RS-30 (available from Sanyo Chemical Industries, Ltd.) (16 parts), styrene (83 parts), methacrylic acid (83 parts), n-butyl acrylate (110 parts), and ammonium persulfate (1 part) were charged to a container equipped with a stirring rod and a thermometer, followed by stirring at 400 rpm for 15 minutes. The mixture was increased in temperature to 75° C. and allowed to react for 5 hours. An aqueous solution of 1% by mass ammonium persulfate (30 parts) was added to the reaction mixture, followed by aging at 75° C. for 5 hours, to obtain [Particles dispersion liquid] that was an aqueous dispersion liquid of a vinyl-based resin dispersion liquid (a copolymer among styrene, methacrylic acid, and a sodium salt of a sulfuric acid ester of methacrylic acid ethylene oxide adduct).

The volume average particle diameter of the [Particles dispersion liquid] measured using LA-920 (available from HORIBA) was 0.14 μm.

Production Example 7

<Preparation of Aqueous Phase>

Water (2,240 parts), the [Particles dispersion liquid] (80 parts), a 48.5% aqueous solution of sodium dodecyl diphenyl ether disulfonate (ELEMINOL MON-7, available from Sanyo Chemical Industries, Ltd.) (80 parts), and ethyl acetate (200 parts) were mixed and stirred to obtain a milky white liquid, which was used as [Aqueous phase].

—Colorant Master Batch—

The following was used as a colorant master batch.

A small-particle-diameter aluminium paste pigment (available from Toyo Aluminium K.K., 2172YC, a volume average particle diameter D50: 7 μm, thickness: 1 μm or less, and propyl acetate dispersoids, solid content: 50%)

Example 1

The [Non-crystalline polyester resin (B2)] (83 parts), the [Crystalline polyester resin (C) dispersion liquid] (50 parts), the Wax dispersion liquid W (35 parts), the [Master batch of organically modified layered inorganic compound] (2 parts), and the [Colorant master batch] (30 parts) were added and sufficiently stirred. A TK homomixer (available from Tokushu Kika Kogyo Co., Ltd.) was used to uniformly dissolve and disperse the materials at 6,000 rpm. Isophoronediamine (IPDA) was added in such an amount that the molar ratio ($NH_2$/NCO) between the amino group of the IPDA and the isocyanate group of the [Reactive precursor (a1)] would be 0.98. The resultant mixture was stirred at 6,000 rpm for 15 seconds using a TK homomixer. A 50% ethyl acetate solution of the [Reactive precursor (a1)] (10 parts) was added to the mixture, followed by stirring at 6,000 rpm for 30 seconds using a TK homomixer, to obtain [Oil phase 1] (solid content: 50%). The aqueous phase (174 parts) was charged into a container equipped with a stirrer and a thermometer and was maintained at 20° C. in a water bath.

The prepared [Oil phase 1] was charged into the aqueous phase, followed by mixing at 8,000 rpm for 2 minutes at a liquid temperature of 20° C. using a TK homomixer (available from Tokushu Kika Kogyo Co., Ltd.) to obtain an emulsified slurry. The oil droplets that formed were somewhat elliptical through observation under an optical microscope.

While maintained at 40° C., the slurry was mixed for 5 minutes at 8,000 rpm using a TK homomixer (available from Tokushu Kika Kogyo Co., Ltd.) to apply a shearing force to the slurry. The oil droplets that formed were slightly spherical through observation under an optical microscope. The solvent was removed at 40° C. under reduced pressure to obtain a slurry containing 0% of the volatile content of the organic solvent.

The slurry was cooled to room temperature and filtrated under reduced pressure. Ion-exchanged water (200 parts) was added to the filtration cake. The resultant was stirred at 800 rpm for 5 minutes using a three-one motor (available from Shinto Scientific Co., Ltd.) for re-slurry, followed by filtration. To the filtration cake were added 1% by mass aqueous sodium hydroxide solution (10 parts) and ion-exchanged water (190 parts). The resultant was re-slurried in the same manner, followed by filtration. To the filtration cake were added 1% by mass hydrochloric acid (10 parts) and ion-exchanged water (190 parts). The resultant was re-slurried in the same manner, followed by filtration. Ion-exchanged water (300 parts) was added to the filtration cake and the resultant was re-slurried and filtrated, which was repeated twice.

A circulating dryer was used to dry the filtration cake at 45° C. for 48 hours, followed by sieving using a mesh having an opening of 75 μm to obtain [Toner base particles 1].

The toner base particles (100 parts), a hydrophobically treated silica HDK-2000 (available from Wacker Chemie) (1 part), and a surface-treated titanium oxide JMT-150IB (available from TAYCA CORPORATION) (1 part) were mixed at a circumferential speed of m/s for 30 seconds using a Henschel mixer (available from Mitsui Mining Co., Ltd.), followed by suspending of the mixing for 1 minute. The above procedure of 30-seconds mixing and 1-minute suspending was repeated five times. The resultant was sieved using a mesh having an opening of 35 μm to obtain Toner 1.

Example 2

[Oil phase 2] and [Toner base particles 2] were obtained in the same manner as in Example 1 except that the [Reactive precursor (a1)] was changed to the [Reactive precursor (a2)]. [Toner 2] was produced in the same manner as in Example 1 except that the [Toner base particles 1] were changed to the [Toner base particles 2].

Example 3

[Oil phase 3] and [Toner base particles 3] were obtained in the same manner as in Example 1 except that the [Reactive precursor (a1)] was changed to the [Reactive precursor (a3)] and the [Non-crystalline polyester resin (B2)] was changed to the [Non-crystalline polyester resin (B1)]. [Toner 3] was produced in the same manner as in Example 1 except that the [Toner base particles 1] were changed to the [Toner base particles 3].

Example 4

[Oil phase 4] and [Toner base particles 4] were obtained in the same manner as in Example 1 except that the [Reactive precursor (a1)] (5 parts) was changed to the [Reactive precursor (a1)] (10 parts) and the [Non-crystalline polyester resin (B2)] (83 parts) was changed to the [Non-crystalline polyester resin (B2)] (78 parts). [Toner 4] was produced in the same manner as in Example 1 except that the [Toner base particles 1] were changed to the [Toner base particles 4].

Example 5

[Oil phase 5] and [Toner base particles 5] were obtained in the same manner as in Example 1 except that the [Reactive precursor (a1)] (5 parts) was changed to the [Reactive precursor (a1)] (15 parts) and the [Non-crystalline polyester resin (B2)] (83 parts) was changed to the [Non-crystalline polyester resin (B2)] (73 parts). [Toner 5] was produced in the same manner as in Example 1 except that the [Toner base particles 1] were changed to the [Toner base particles 5].

Example 6

[Oil phase 6] and [Toner base particles 6] were obtained in the same manner except that the [Reactive precursor (a1)] (5 parts) was changed to the [Reactive precursor (a4)] (10 parts) and the [Non-crystalline polyester resin (B2)] (83 parts) was changed to the [Non-crystalline polyester resin (B2)] (78 parts). [Toner 6] was produced in the same manner as in Example 1 except that the [Toner base particles 1] were changed to the [Toner base particles 6].

Example 7

[Oil phase 7] and [Toner base particles 7] were obtained in the same manner as in Example 1 except that the [Reactive precursor (a1)] (5 parts) was changed to the [Reactive precursor (a5)] (10 parts) and the [Non-crystalline polyester resin (B2)] (83 parts) was changed to the [Non-crystalline polyester resin (B2)] (78 parts). [Toner 7] was produced in the same manner as in Example 1 except that the [Toner base particles 1] were changed to the [Toner base particles 7].

Comparative Example 1

[Oil phase 8] and [Toner base particles 8] were obtained in the same manner as in Example 1 except that the [Reactive precursor (a1)] (5 parts) was changed to the [Reactive precursor (a2)] (10 parts) and the [Non-crystalline polyester resin (B2)] (83 parts) was changed to the [Non-crystalline polyester resin (B3)] (78 parts). [Toner 8] was produced in the same manner as in Example 1 except that the [Toner base particles 1] were changed to the [Toner base particles 8].

Comparative Example 2

[Oil phase 9] and [Toner base particles 9] were obtained in the same manner as in Example 1 except that the [Reactive precursor (a1)] was changed to the [Reactive precursor (a6)] and the [Non-crystalline polyester resin (B2)] was changed to the [Non-crystalline polyester resin (B1)]. [Toner 9] was obtained in the same manner as in Example 1 except that the [Toner base particles 1] were changed to the [Toner base particles 9].

Comparative Example 3

[Oil phase 10] and [Toner base particles 10] were obtained in the same manner as in Example 1 except that the [Reactive precursor (a1)] was changed to the [Reactive precursor (a7)] and the [Non-crystalline polyester resin (B2)] was changed to the [Non-crystalline polyester resin (B1)]. [Toner 10] was obtained in the same manner as in Example 1 except that the [Toner base particles 1] were changed to the [Toner base particles 10].

Table 1 presents the formulations of the [Toner 1] to the [Toner 10] of Examples 1 to 7 and Comparative Examples 1 to 3.

Table 2 presents the values of physical properties of the [Toner 1] to the [Toner 10].

Here, the value presenting the amount of each component in the toner in Table 1 is on the solid content basis.

The values of physical properties presented in Table 2; i.e., the weight average molecular weight, the glass transition temperature, and the amount of THF-insoluble component were determined by the methods described above in the sections <Weight average molecular weight (Mw) of THF-soluble component> and <Polyester resin (A) insoluble in THF>.

<Production of Developer 1 to Developer 10>

Using a Turbula mixer (available from Willy A. Bachofen AG (WAB)) configured to roll a container for stirring, the [Toner 1] (7 parts) was homogeneously mixed with [Carrier] (100 parts) at 48 rpm for 5 minutes, to prepare [Developer 1] as a two-component developer.

[Developer 2] to [Developer 10] were obtained in the same manner as in the production of [Developer 1] except that the [Toner 1] was changed to the [Toner 2] to the [Toner 10].

[Evaluation]

The [Developer 1] to the [Developer 10] were used to evaluate a fixing temperature range and image exfoliation for the [Toner 1] to the [Toner 10]. Table 3 presents evaluation results.

As presented in Table 3, the toner of the present disclosure can solve the existing problems in the art and can achieve the object of the present disclosure.

<Evaluation Methods>

Evaluation methods are presented below.

<<Fixing Temperature Range>>

The developer was loaded into a color production printer RICOH PRO C7200S (available from Ricoh Company, Ltd.) for evaluation. On a transfer paper sheet (available from Ricoh Business Expert Co., LTD., copying paper <70>), a solid image (image size: 3 cm×8 cm) was formed at a position of 3.0 cm away from the leading edge of the transfer paper sheet in the paper feeding direction so that the toner deposition amount after transfer would be 0.85±0.1 mg/cm$^2$, followed by fixing while changing the temperature of the fixing belt.

The minimum fixing temperature is defined as the lowest temperature at which almost no offset occurs (i.e., the number of occurrences of offset is less than 5). The maximum fixing temperature is defined as the highest temperature at which glossiness is decreased by 10% or less as compared with the maximum glossiness. The fixing temperature range is a temperature range between the minimum fixing temperature and the maximum fixing temperature. The wider the fixing temperature range, the more excellent the fixability.

<<Fixing Exfoliation Rank>>

In the solid image at the minimum fixing temperature obtained in the same manner as in the evaluation of the fixing temperature range, the surface of the fixed image was scratched using a scratch tester AD-401 (available from Ueshima Seisakusho Co., Ltd.) with a ruby needle (radius of the tip: from 260 μm R through 320 μm R, tip angle: 60 degrees) under application of a load of 50 g. Then, the scratched surface was strongly rubbed 10 times using a non-woven fabric ("HANIKOTTO #440", available from HONEYLON CORPORATION). The degree of image exfoliation was ranked for evaluation.

[Evaluation Criteria]

Rank 5: The image was not exfoliated.

Rank 4: The scratched portions were somewhat exfoliated.

Rank 3: Half of the scratched portions was exfoliated.

Rank 2: All of the scratched portions were exfoliated.

Rank 1: The scratched portions and the other portions than the scratched portions were both exfoliated.

TABLE 1

| | | | Polyester resin (A) | | Non-crystalline polyester resin (B) | | Crystalline polyester | Wax | Wax dispersant | APA | Colorant master |
|---|---|---|---|---|---|---|---|---|---|---|---|
| Example/ Comparative Example No. | Toner No. | Toner base particles No. | Kind of reactive precursor | Parts by mass | Kind of resin | Parts by mass | resin (C) (parts by mass) | (parts by mass) | (parts by mass) | (part by mass) | batch (parts by mass) |
| Example 1 | Toner 1 | Toner base particles 1 | Reactive precursor (a1) | 5 | Non-crystalline polyester resin (B2) | 83 | 5 | 5 | 2 | 1 | 15 |
| Example 2 | Toner 2 | Toner base particles 2 | Reactive precursor (a2) | 5 | Non-crystalline polyester resin (B2) | 83 | 5 | 5 | 2 | 1 | 15 |
| Example 3 | Toner 3 | Toner base particles 3 | Reactive precursor (a3) | 5 | Non-crystalline polyester resin (B1) | 83 | 5 | 5 | 2 | 1 | 15 |
| Example 4 | Toner 4 | Toner base particles 4 | Reactive precursor (a1) | 10 | Non-crystalline polyester resin (B2) | 78 | 5 | 5 | 2 | 1 | 15 |
| Example 5 | Toner 5 | Toner base particles 5 | Reactive precursor (a1) | 15 | Non-crystalline polyester resin (B2) | 73 | 5 | 5 | 2 | 1 | 15 |
| Example 6 | Toner 6 | Toner base particles 6 | Reactive precursor (a4) | 10 | Non-crystalline polyester resin (B2) | 78 | 5 | 5 | 2 | 1 | 15 |
| Example 7 | Toner 7 | Toner base particles 7 | Reactive precursor (a5) | 10 | Non-crystalline polyester resin (B2) | 78 | 5 | 5 | 2 | 1 | 15 |
| Comparative Example 1 | Toner 8 | Toner base particles 8 | Reactive precursor (a2) | 10 | Non-crystalline polyester resin (B3) | 78 | 5 | 5 | 2 | 1 | 15 |
| Comparative Example 2 | Toner 9 | Toner base particles 9 | Reactive precursor (a6) | 5 | Non-crystalline polyester resin (B1) | 83 | 5 | 5 | 2 | 1 | 15 |
| Comparative Example 3 | Toner 10 | Toner base particles 10 | Reactive precursor (a7) | 5 | Non-crystalline polyester resin (B1) | 83 | 5 | 5 | 2 | 1 | 15 |

TABLE 2

| | | Value of physical | Values of physical properties of THF-insoluble component | |
|---|---|---|---|---|
| Example/ Comparative Example No. | Toner No. | property of toner Weight average molecular weight | Glass transition temperature (° C.) | Amount of THF-insoluble component (%) |
| Example 1 | Toner 1 | 9,500 | −35 | 4.1 |
| Example 2 | Toner 2 | 13,500 | 8 | 4.5 |
| Example 3 | Toner 3 | 5,000 | −51 | 4.2 |
| Example 4 | Toner 4 | 9,500 | −35 | 6.1 |
| Example 5 | Toner 5 | 9,400 | −35 | 14.6 |

TABLE 2-continued

| Example/ Comparative Example No. | Toner No. | Value of physical property of toner Weight average molecular weight | Values of physical properties of THF-insoluble component Glass transition temperature (° C.) | Amount of THF-insoluble component (%) |
|---|---|---|---|---|
| Example 6 | Toner 6 | 11,500 | −45 | 8.2 |
| Example 7 | Toner 7 | 9,000 | −35 | 6.9 |
| Comparative Example 1 | Toner 8 | 16,000 | 8 | 8.9 |
| Comparative Example 2 | Toner 9 | 6,000 | −70 | 4.2 |
| Comparative Example 3 | Toner 10 | 10,500 | 55 | 4.4 |

TABLE 3

| Example/ Comparative Example No. | Toner No. | Fixing temperature range (° C.) | Image exfoliation rank |
|---|---|---|---|
| Example 1 | Toner 1 | 40 | 4 |
| Example 2 | Toner 2 | 45 | 3 |
| Example 3 | Toner 3 | 35 | 5 |
| Example 4 | Toner 4 | 45 | 5 |
| Example 5 | Toner 5 | 45 | 5 |
| Example 6 | Toner 6 | 45 | 4 |
| Example 7 | Toner 7 | 40 | 4 |
| Comparative Example 1 | Toner 8 | 45 | 2 |
| Comparative Example 2 | Toner 9 | 20 | 3 |
| Comparative Example 3 | Toner 10 | 45 | 2 |

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

The invention claimed is:

1. A toner comprising:

a plate-shaped pigment containing a metal as a main component; and a binder resin containing polyester resin (A) that is insoluble in THF, wherein:

a weight average molecular weight (Mw) of a tetrahydrofuran (THF)-soluble component of the toner as determined by gel permeation chromatography (GPC) is 5,000 or higher but 14,000 or lower; and a glass transition temperature (Tg) of a THE-insoluble component of the toner as determined from a differential scanning colorimetry (DSC) curve at first heating in DSC is −60° C. or higher but 10° C. or lower.

2. The toner according to claim 1, wherein a proportion of the THF-insoluble component in the toner is 5% by mass or more but 15% by mass or less.

3. The toner according to claim 1, wherein the polyester resin (A) contains at least one of a urethane bond and a urea bond.

4. The toner according to claim 1, wherein the polyester resin (A) contains an alcohol component as a constituting component of the polyester resin (A), the alcohol component contains an aliphatic diol having from 3 through 10 carbon atoms in an amount of 50 mol % or more of the alcohol component, and a main chain of the aliphatic diol has a structure represented by General Formula (1) below:

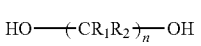

General Formula (1)

where $R_1$ and $R_2$ are each independently a hydrogen atom or an alkyl group having from 1 through 3 carbon atoms, and n is an odd number of from 3 through 9, provided that $R_1$ and $R_2$ may be identical to or different from each other in units repeated in number of n.

5. The toner according to claim 1, wherein the toner has a circularity of from 0.950 through 0.985.

6. A toner stored unit comprising the toner according to claim 1, which is stored in the toner stored unit.

7. An image forming apparatus comprising:

an electrostatic latent image bearer;

an electrostatic latent image forming unit configured to form an electrostatic latent image on the electrostatic latent image bearer;

a developing unit containing the toner according to claim 1 and configured to develop the electrostatic latent image formed on the electrostatic latent image bearer with the toner to form a toner image;

a transfer unit configured to transfer the toner image formed on the electrostatic latent image bearer onto a surface of a recording medium; and a fixing unit configured to fix the toner image transferred onto the surface of the recording medium.

* * * * *